US008731438B2

(12) United States Patent
Okabe

(10) Patent No.: US 8,731,438 B2
(45) Date of Patent: May 20, 2014

(54) IMAGE FORMING DEVICE AND CARTRIDGE THAT TRANSMIT A DRIVING FORCE

(75) Inventor: Yasushi Okabe, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 228 days.

(21) Appl. No.: 12/878,021

(22) Filed: Sep. 8, 2010

(65) Prior Publication Data

US 2011/0058851 A1 Mar. 10, 2011

(30) Foreign Application Priority Data

Sep. 9, 2009 (JP) ..... 2009-208382

(51) Int. Cl.
*G03G 15/00* (2006.01)

(52) U.S. Cl.
USPC ..... 399/167

(58) Field of Classification Search
USPC ..... 399/116, 117, 167
See application file for complete search history.

(56) References Cited

U.S. PATENT DOCUMENTS

| | | | | |
|---|---|---|---|---|
| 6,196,178 | B1 | 3/2001 | Minegishi et al. | |
| 6,574,446 | B2 * | 6/2003 | Kitayama | 399/167 |
| 7,228,090 | B2 * | 6/2007 | Toso et al. | 399/167 |
| 7,236,722 | B2 * | 6/2007 | Portig | 399/167 |
| 7,623,811 | B2 * | 11/2009 | Sato | 399/167 |
| 2002/0044794 | A1 | 4/2002 | Nishiuwatoko et al. | |
| 2007/0003321 | A1 | 1/2007 | Hara et al. | |
| 2007/0122188 | A1 | 5/2007 | Igarashi | |
| 2008/0152388 | A1 | 6/2008 | Ueno et al. | |
| 2008/0240796 | A1 | 10/2008 | Morioka et al. | |
| 2009/0169247 | A1 | 7/2009 | Hattori | |
| 2009/0317129 | A1 * | 12/2009 | Abe et al. | |

FOREIGN PATENT DOCUMENTS

| | | | |
|---|---|---|---|
| EP | 1178370 | A2 | 2/2002 |
| EP | 1195651 | A2 | 4/2002 |
| JP | H01-164818 | A | 6/1989 |

(Continued)

OTHER PUBLICATIONS

State Intellectual Property Office of the People's Republic of China, The First Office Action for Chinese Patent Application No. 201010286482.3 (counterpart to above-captioned patent application), mailed Mar. 12, 2012.

(Continued)

*Primary Examiner* — David Gray
*Assistant Examiner* — Laura Roth
(74) *Attorney, Agent, or Firm* — Baker Botts L.L.P.

(57) ABSTRACT

An image forming device comprises a device main body; a cartridge attachable to the device main body; a main body transmission unit to rotate about a first rotation axis; a main body joint unit to rotate about a second rotation axis allowed to intersect with the first rotation axis; a cartridge transmission unit configured to rotate about a third rotation axis and to transmit a driving force to a rotation body; and a cartridge joint unit to rotate about a fourth rotation axis allowed to intersect with the third rotation axis. The cartridge joint unit is further configured to rotate coaxially with respect to the main body joint unit and to rotate the cartridge transmission unit when the main body transmission unit rotates in a state where the cartridge is attached to the device main body and the cartridge joint unit is coupled to the main body joint unit.

10 Claims, 10 Drawing Sheets

(56) References Cited

FOREIGN PATENT DOCUMENTS

| | | | |
|---|---|---|---|
| JP | H05-094535 | U | 12/1993 |
| JP | H06-337018 | A | 12/1994 |
| JP | H11-294195 | A | 10/1999 |
| JP | 2002-182446 | A | 6/2002 |
| JP | 2006-084622 | A | 3/2006 |
| JP | 2007-011093 | A | 1/2007 |
| JP | 2007-147881 | A | 6/2007 |
| JP | 2007-240007 | A | 9/2007 |
| JP | 2008-268927 | A | 11/2008 |
| JP | 2008-298804 | A | 12/2008 |
| JP | 2008-309871 | A | 12/2008 |
| JP | 2009-162915 | A | 7/2009 |

OTHER PUBLICATIONS

Japan Patent Office, Notification of Reasons for Rejection for Japanese Patent Application No. 2009-208382 (counterpart to above-captioned patent application), dispatched Feb. 21, 2012.

Japan Patent Office, Notification of Reasons for Rejection for Japanese Patent Application No. 2009-208382 (counterpart to above-captioned patent application), dispatched Jul. 26, 2011.

State Intellectual Property Office of the People's Republic of China, The Second Office Action for Chinese Patent Application No. 201010286482.3 (counterpart Chinese patent application), mailed Oct. 30, 2012.

State Intellectual Property Office of the People's Republic of China, Office Action for Chinese patent application No. 201010286482.3 (counterpart Chinese patent application), mailed May 6, 2013.

* cited by examiner

FIG.3A
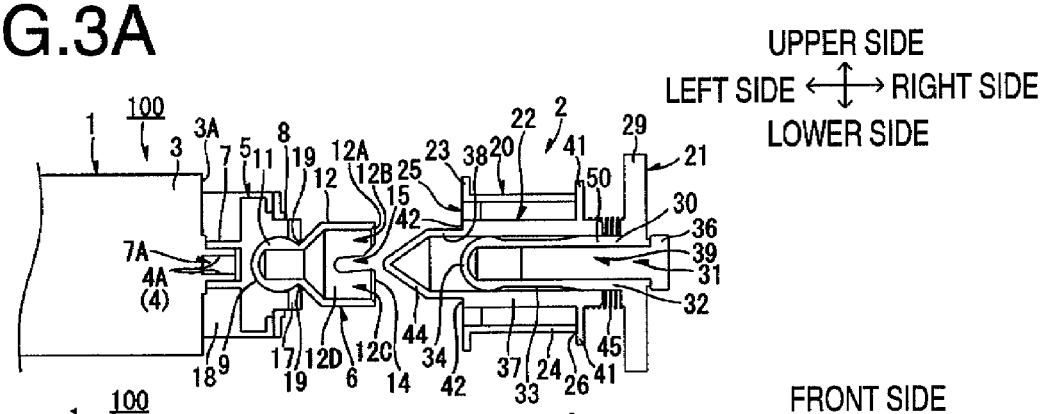
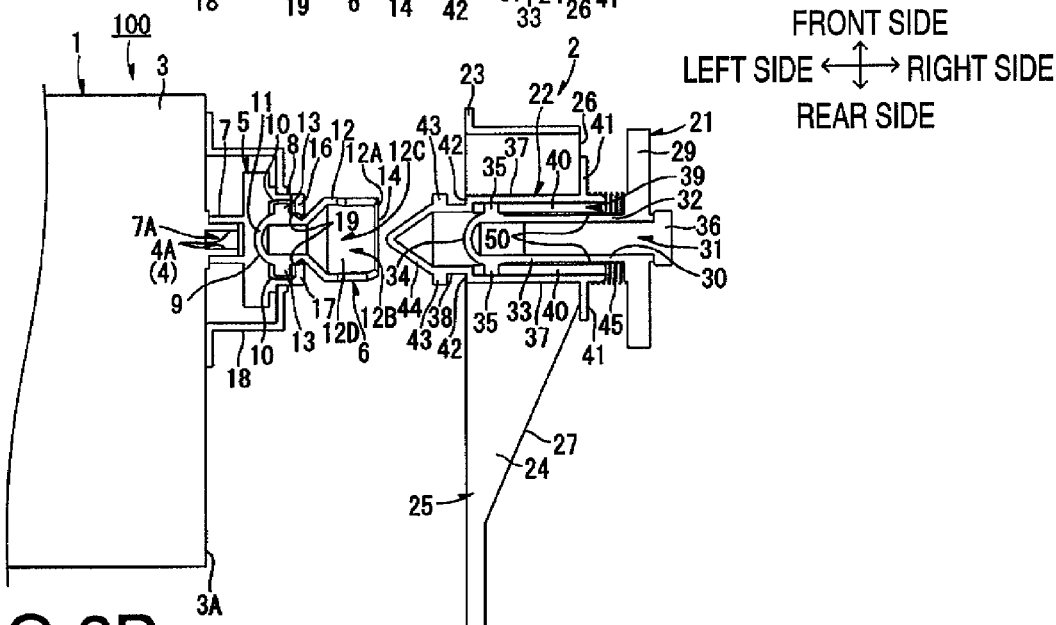
FIG.3B
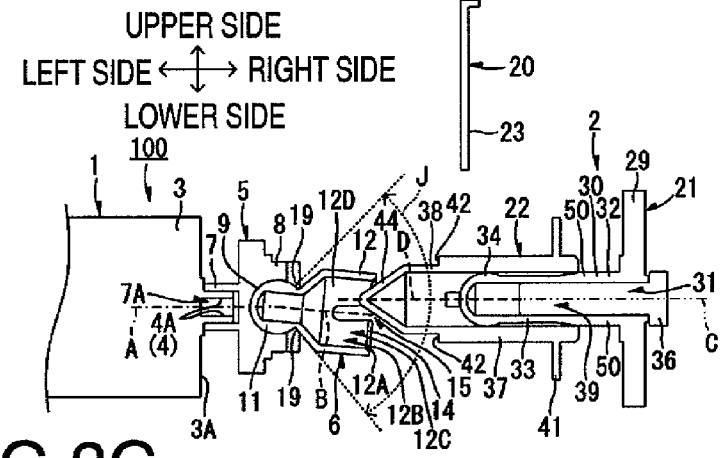
FIG.3C

IMAGE FORMING DEVICE AND CARTRIDGE THAT TRANSMIT A DRIVING FORCE

CROSS-REFERENCE TO RELATED APPLICATION

This application claims priority under 35 U.S.C. §119 from Japanese Patent Application No. 2009-208382, filed on Sep. 9, 2009. The entire subject matter of the application is incorporated herein by reference.

BACKGROUND

1. Technical Field

Aspects of the present invention relate to an image forming device, such as a laser printer, and a cartridge attached to the image forming device.

2. Related Art

Image forming devices configured such that a process cartridge is detachably attachable to a main body casing of the image forming device have been widely used. For example, the process cartridge is configured to have a drum cartridge holding a photosensitive drum and a development cartridge holding a development roller. In this configuration, the development cartridge is detachably attachable to the drum cartridge.

The development cartridge is provided with a driven gear for receiving a driving force from the main body casing. The driven gear of the development cartridge is formed to be exposed to the outside of a casing of the process cartridge. The driven gear is supported by the casing of the process cartridge to be rotatable, and a recessed part is formed in the driven gear.

On the other hand, the main body casing is provided with a transmission member at a position facing the driven gear of the development cartridge to transmit the driving force to the development cartridge. Specifically, the transmission member includes a driving gear supported by the main body casing and an advancing member capable of advancing along a rotation axis of the driving gear. When the advancing member is situated at an advanced position, the advancing member engages with the driven gear by fitting into the recessed part of the driven gear.

When a drive motor in the main body casing rotates to produce a driving force, the driving gear and the advancing member of the transmission member rotate together, and thereby the driven gear of the development cartridge rotates together with the advancing member.

By configuring the advancing member as a universal joint such that a rotation axis of the advancing member is allowed to intersect with the rotation axis of the driving gear, the advancing member can be coupled to the driven gear of the development cartridge in a state where the rotation axis of the driving gear does not coincide with the rotation axis of the driven gear.

SUMMARY

In order to enable the advancing member and the driven gear to smoothly rotate in the state where the rotation axis of the advancing member intersects with the rotation axis of the driven gear, in general a lubricating oil, such as grease, is applied to the recessed part of the driven gear. Therefore, when the development cartridge is detached from the main body casing, the grease applied to the recessed part of the driven gear is exposed to the outside of the development cartridge. In this case, a user may soil the user's hand or clothes with the grease exposed to the outside of the development cartridge. Further, foreign material may adhere to the grease, thereby clogging the recessed part of the driven gear.

Aspects of the present invention are advantageous in that usability can be enhanced in a configuration where a cartridge is detachably attachable to a device main body having a driving source to transmit a driving force to the cartridge.

According to an aspect of the invention, there is provided an image forming device, comprising: a device main body having a driving source generating a driving force; a cartridge that is formed to be detachably attachable to the device main body and to include a rotation body provided to rotate by receiving the driving force from the driving source; a main body transmission unit that is provided in the device main body, the main body transmission unit being configured to rotate about a first rotation axis by receiving the driving force from the driving source; a main body joint unit that is supported by the main body transmission unit, the main body joint unit being configured such that, in accordance with rotation of the main body transmission unit, the main body joint unit rotates about a second rotation axis which is allowed to intersect with the first rotation axis; a cartridge transmission unit that is provided in the cartridge, the cartridge transmission unit being configured to be able to rotate about a third rotation axis and to transmit the driving force from the driving source to the rotation body by rotating about the third rotation axis; and a cartridge joint unit that is supported by the cartridge transmission unit, the cartridge joint unit being configured to be able to rotate about a fourth rotation axis which is allowed to intersect with the third rotation axis, and configured to rotate coaxially with respect to the main body joint unit and to cause the cartridge transmission unit to rotate when the main body transmission unit rotates in a state where the cartridge is attached to the device main body and the cartridge joint unit is coupled to the main body joint unit.

BRIEF DESCRIPTION OF THE ACCOMPANYING DRAWINGS

FIG. 3A is a cross section viewed along a line A-A in FIG. 2A, FIG. 3B is a cross section viewed along a line B-B in FIG. 2B, and FIG. 3C illustrates a situation where a cartridge joint unit is inclined downward to the right side.

Figure 8A:
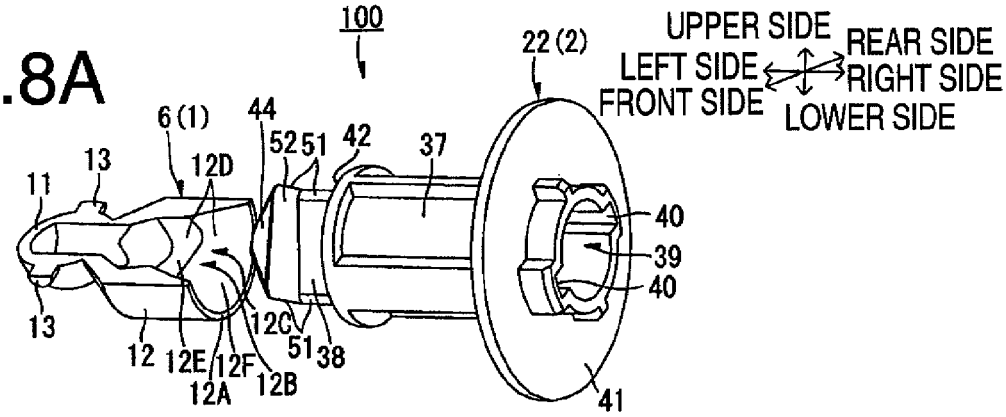
Figure 8B:
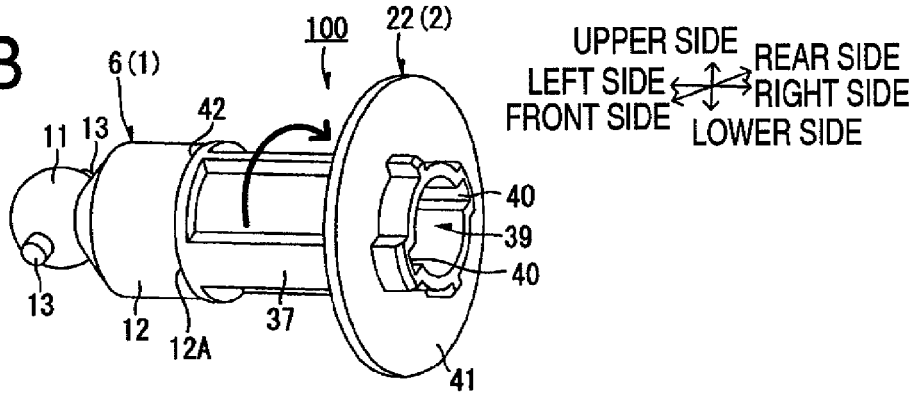
Figure 8C:
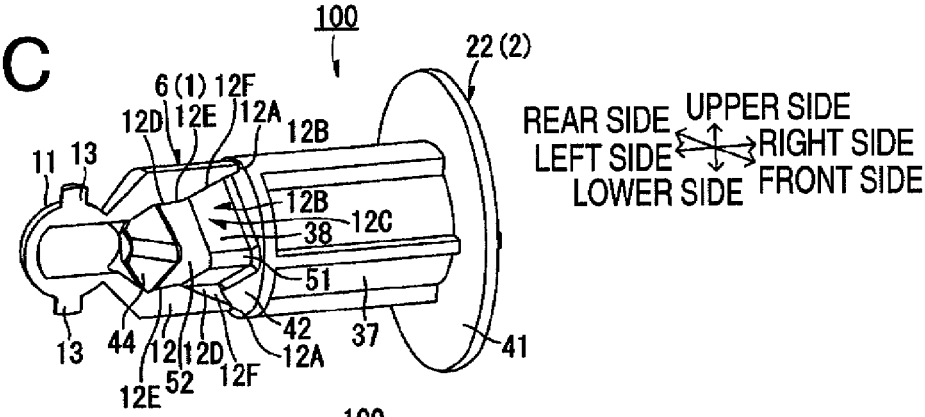
Figure 8D:
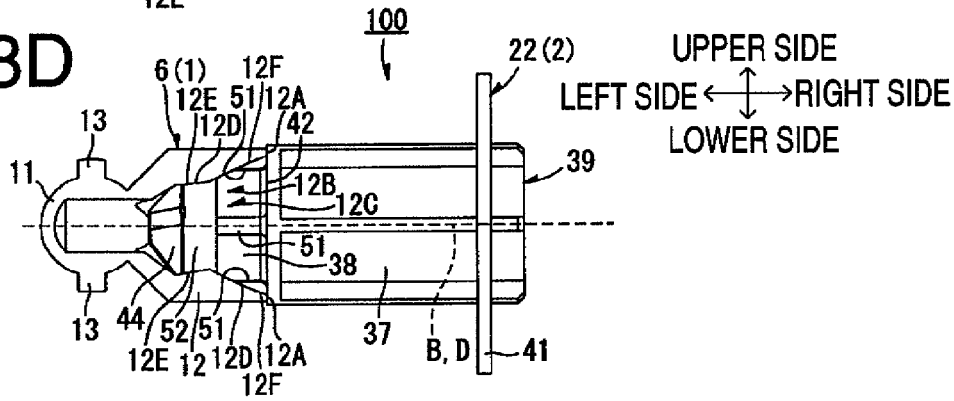

FIG. 8A is a perspective view of a first variation illustrating the cartridge joint unit and the main body joint unit which are not coupled to each other, FIG. 8B is a perspective view of the coupled cartridge joint unit and the main body joint unit viewed from the upper right side, FIG. 8C is a perspective view of the coupled cartridge joint unit and the main body joint unit viewed from the front on the left side partially illustrating a cross section, and FIG. 8D is a front view of the coupled cartridge joint unit and the main body joint unit illustrating partially a cross section.

Figure 9A:
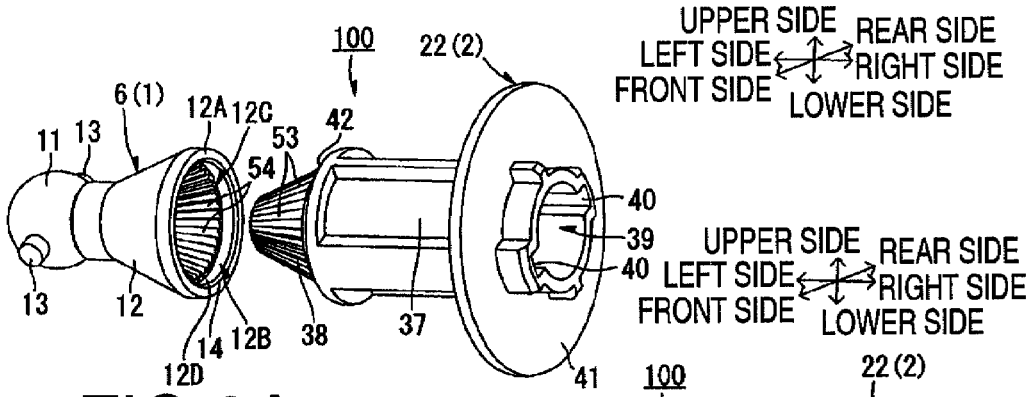
Figure 9D:
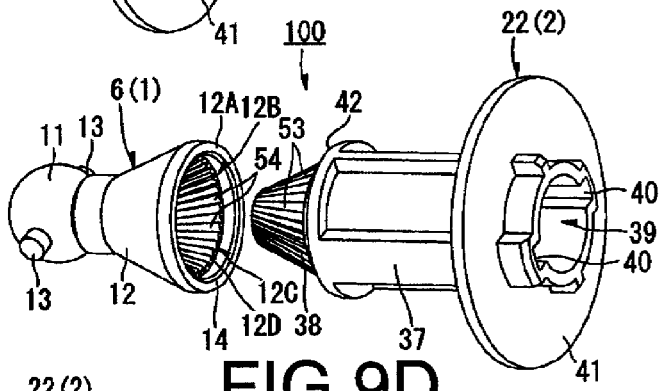
Figure 9B:
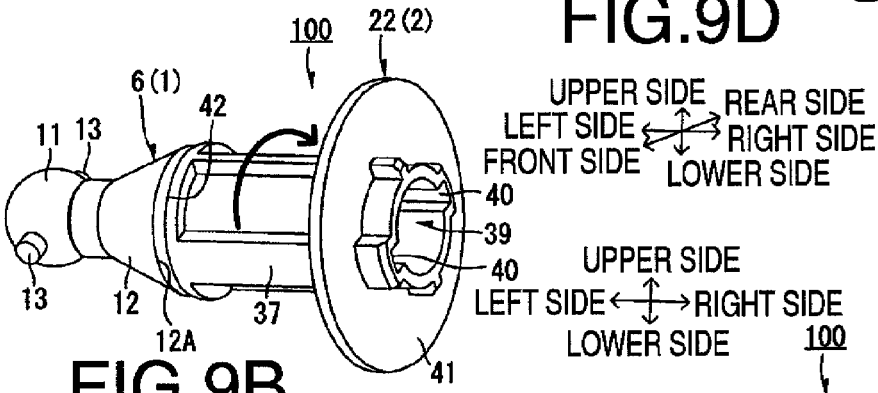
Figure 9C:
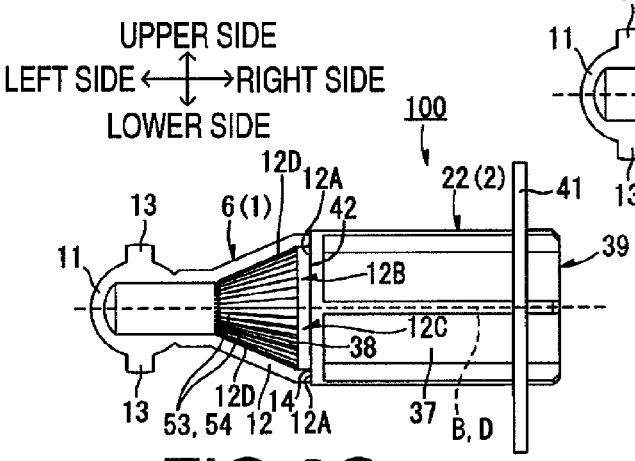
Figure 9E:
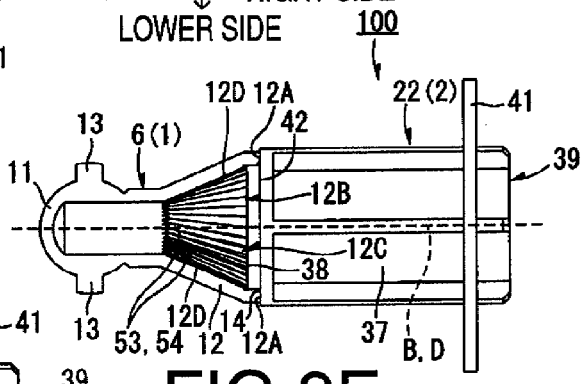

FIG. 9A is a perspective view of a second variation illustrating the cartridge joint unit and the main body joint unit which are not coupled to each other, FIG. 9B is a perspective view of the coupled cartridge joint unit and the main body joint unit of the second variation viewed from the upper right side, FIG. 9C is a front view of the coupled cartridge joint unit and the main body joint unit of the second variation illustrating partially a cross section, FIG. 9D is a perspective view of a third variation illustrating the cartridge joint unit and the main body joint unit which are not coupled to each other, and FIG. 9E is a front view of the coupled cartridge joint unit and the main body joint unit of the third variation illustrating partially a cross section.

Figure 10A:
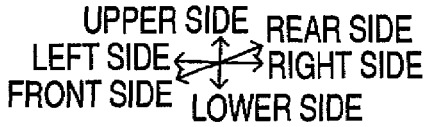
Figure 10A:
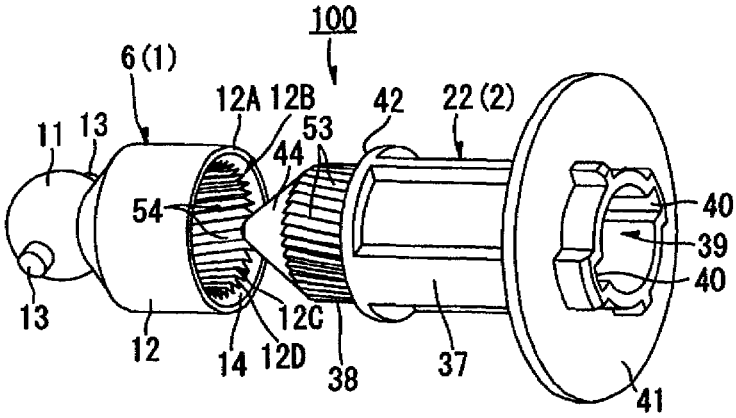
Figure 10B:
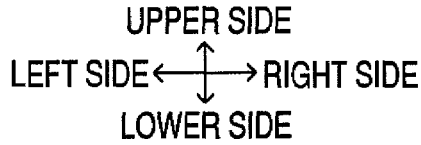
Figure 10B:
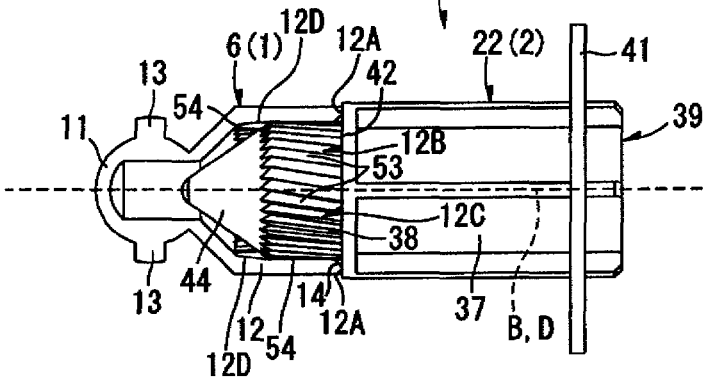

FIG. 10A is a perspective view of a fourth variation illustrating the cartridge joint unit and the main body joint unit which are not coupled to each other, and FIG. 10B is a front view of the coupled cartridge joint unit and the main body joint unit of the fourth variation illustrating partially a cross section.

DETAILED DESCRIPTION

Hereafter, an embodiment according to the invention will be described with reference to the accompanying drawings. In the following, explanations are made with reference to directions defined in the drawings.

Figure 2A:
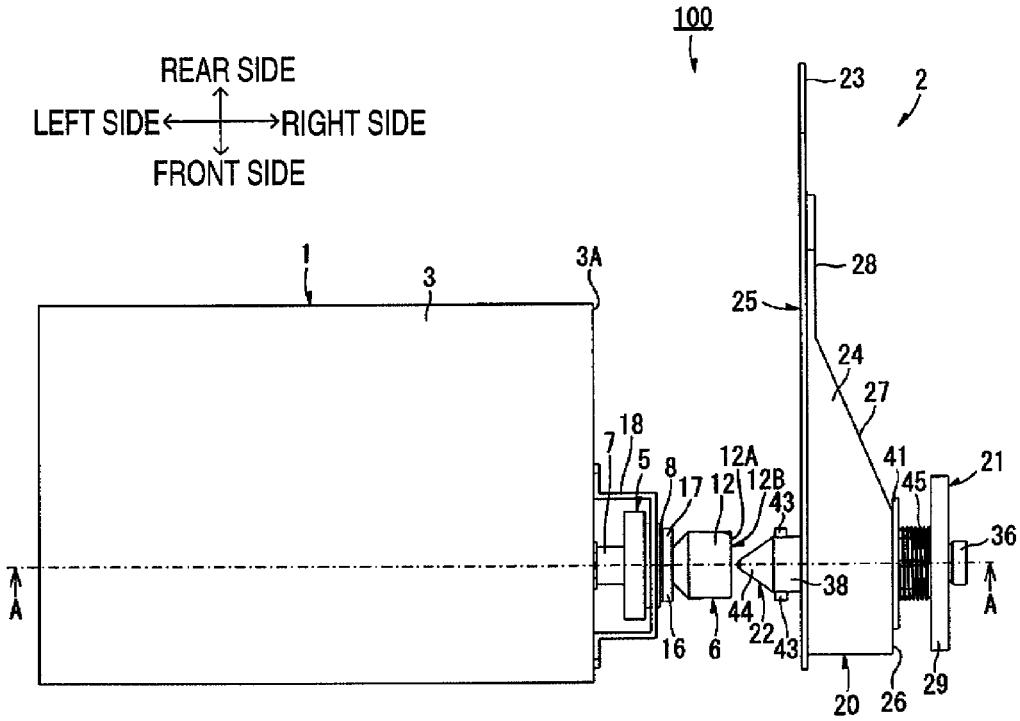
FIG. 2A is a plan view of a main part of an image forming device illustrating a part of a device main body and the cartridge where a main body joint unit is situated at a retracted position.
Figure 2B:
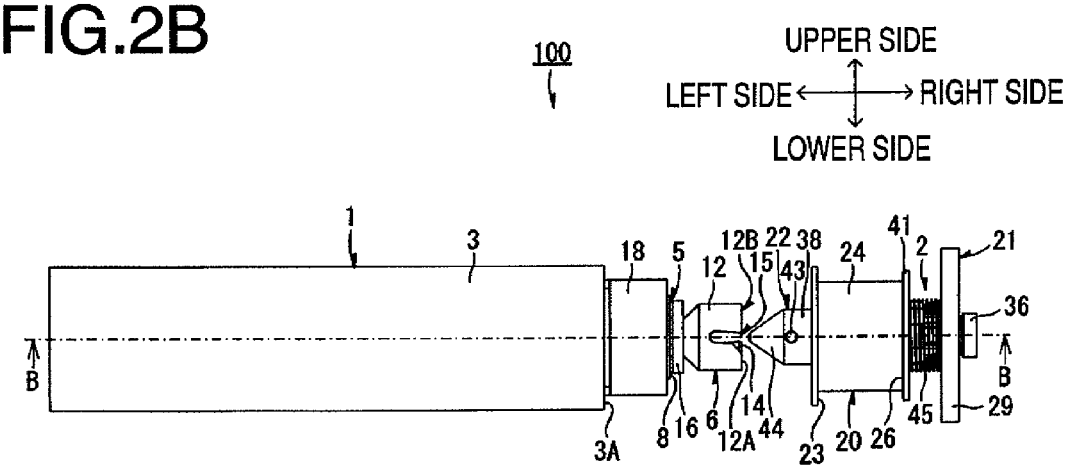
FIG. 2B is a front view of the main part of the image forming device illustrating a part of the device main body and the cartridge.

An image forming device 100 (see FIGS. 2A and 2B) is, for example, a laser printer. As shown in FIGS. 2A and 2B, the image forming device 100 includes a cartridge 1 and a device main body 2. In the following, the cartridge 1 and the device main body 2 are explained in this order.

As shown in FIG. 2B, the cartridge 1 is configured to be detachably attachable to the device main body 2. Referring to FIG. 1B, the cartridge 1 includes a casing 3 which forms an outer appearance of the cartridge 1, a rotation body 4, a cartridge transmission unit 5, and a cartridge joint unit 6. The rotation body 4 is rotatably supported by the casing 3, and rotates when receiving a driving force from the device main body 2. The cartridge transmission unit 5 serves to transmit the driving force to the rotation body 4. The cartridge joint unit 6 receives the driving force from the device main body 2, and transmits the driving force to the cartridge transmission unit 5.

The cartridge 1 is configured to accommodate a developer (toner), for example, in the casing 3. That is, the cartridge 1 is configured to be a consumable which is replaced with a new one each time the toner in the casing 3 decreases to a predetermined amount with execution of image formation.

Figure 1A:
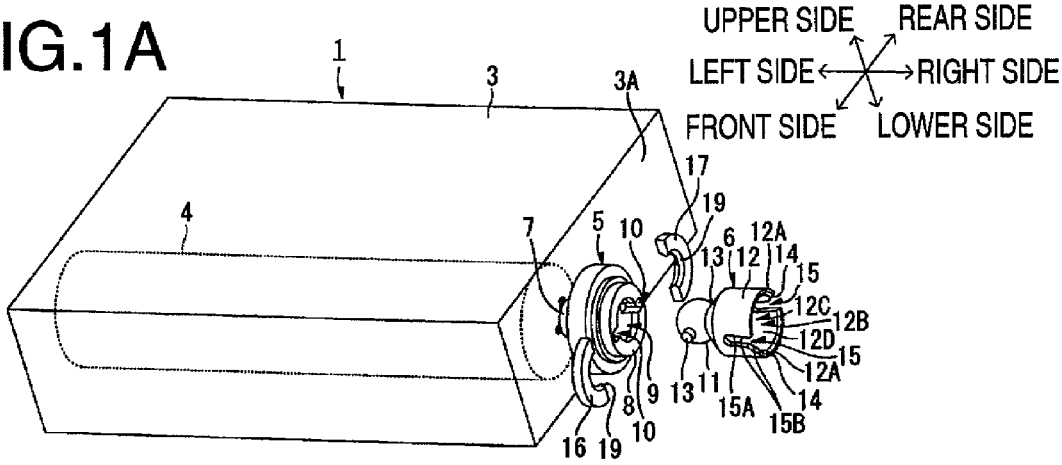
FIG. 1A is an exploded perspective view of a cartridge according to an embodiment.
Figure 1B:
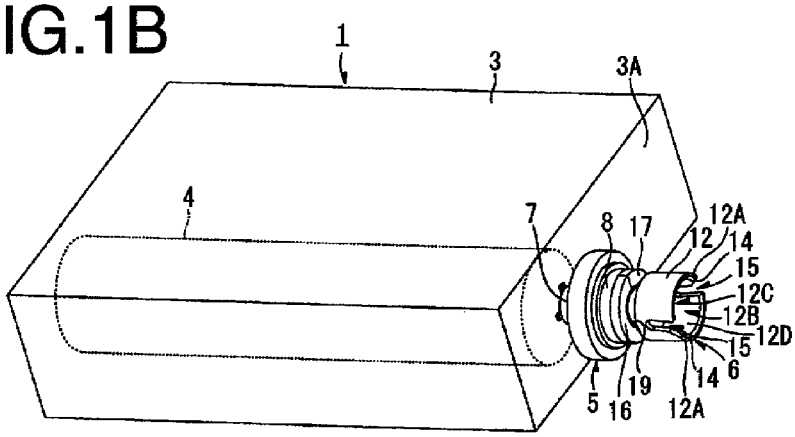
FIG. 1B is a perspective view of the completed cartridge.
Figure 1C:
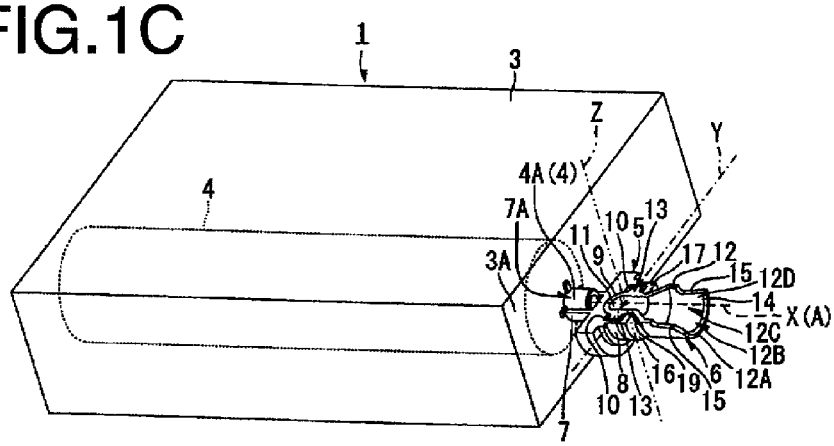
FIG. 1C illustrates a cross section of a main part of the cartridge.

The rotation member 4 is a cylindrical member having a rotation shaft 4A extending in a width direction (see FIG. 1C). The rotation member 4 is, for example, a development roller (a developer holding body) which holds the toner on an outer circumferential surface thereof, or a photosensitive drum having an outer circumferential surface on which an electrostatic latent image is formed. As shown in FIG. 1C, the right end of the rotation shaft 4A is exposed to the outside of the casing 3 toward the right side, from a right surface 3A of the casing 3.

In FIG. 1C, the cartridge transmission unit 5 and the cartridge joint unit 6 are cut at a substantially central position in the vertical direction by a substantially horizontal plane, so that lower half parts of the cartridge transmission unit 5 and the cartridge joint unit 6 and a cut surface thereof are illustrated. The cartridge transmission unit 5 is a thin circular plate-like member having the center equal to the rotation shaft 4A.

On a left end surface of the cartridge transmission unit 5, a left fitting part 7 having a cylindrical shape protruding to the left side from the circle center of the cartridge transmission unit 5 is integrally formed. The left fitting part 7 has a center axis coinciding with the center axis of the cartridge transmission unit 5. At the left end of the left fitting part 7, an opening 7A is formed, and the inner part of the left fitting part 7 is opened toward the left side through the opening 7A.

As shown in FIG. 1A, on a circular right end surface of the cartridge transmission unit 5, a right fitting part 8 having a form of a cylindrical column protruding toward the right side from the circle center of the cartridge transmission unit 5 is integrally formed. The right fitting part 8 has the center axis coinciding with the center axis of the cartridge transmission unit 5. The right fitting part 8 is formed to have a small diameter part whose diameter is decreased by one step toward the right side. The right end surface of the right fitting part 8 is a vertical surface, and has a circular shape when viewed from the right side.

At the circle center on the right end surface of the right fitting part 8, a receiving part 9 which is recessed toward the left side is formed. The receiving part 9 is formed to have a circular shape having the circle center equal to the circle center of the right fitting part 8, when viewed from the right side. On the right end surface of the right side fitting unit 8, i.e., on the circular periphery of the receiving part 9, two recessions 10 are arranged at the same intervals along the circular periphery. That is, the two recessions 10 are positioned to be shifted with respect to each other by 180 degrees along the circular periphery of the receiving part 9. Each of the recessions 10 is formed to be recessed toward the left side and toward the outside in the radial direction of the right fitting part 8. Each recession 10 is formed to continue to the receiving part 9. That is, each recession 10 is formed as a part of the receiving part 9.

The cartridge joint unit 6 includes a ball part 11 and a cup part 12 which are integrally provided. The cup part 12 is provided on the right side of the ball part 11. The ball part 11 has a spherical shape. On the outer surface of the ball part 11, two protrusions 13 protruding outward in the radial direction of the ball part 11 are formed. In FIG. 1A, the two protrusions 13 are arranged to have the same interval in the circumferential direction of the ball part 11, at the central position in the width direction of the ball part 11. That is, the center of the ball part 11 is positioned at the center of a line connecting the two protrusions 13.

The cup part 12 has a cylindrical shape having the center axis passing through the center of the ball part 11, and is formed to extend to the right side from the ball part 11. The cup part 12 has the center axis equal to the center axis of the cartridge joint unit 6. The cup part 12 has the outer diameter which is larger than the outer diameter of the ball part 11. A left end portion of the cup part 12 has a conical shape formed such that the size thereof decreases gradually toward the left side, and connects with the ball part 11 from the right side.

A right end surface 12A of the cup part 12 is a plane surface which is orthogonal to the center axis (which is equal to the rotation axis B of the cartridge joint part 6) of the cup part 12. At the right end surface 12A, a circular hole 12B which has a circular shape when viewed from the right side is formed. Therefore, when viewed from the right side, the right end surface 12A has an annular shape surrounding the circular hole 12B. The inner space of the cup part 12 is formed as a receiving part 12C which is recessed to the left side and has a cylindrical shape having the center axis equal to the center axis of the cup part 12. The receiving part 12C is opened toward the right side through the circular hole 12B. An inner surface 12D which defines the receiving part 12C in the cup part 12 has a cylindrical shape having the center axis equal to the center axis of the cup part 12. Strictly, the left end part of the inner surface 12D has a shape of a truncated cone tapering toward the left side (se FIGS. 3A to 3C).

The right edge of the circular inner surface 12D and the inner perimeter of the annular right end surface 12A are connected by a slanting surface 14 extending from the inner perimeter of the right end surface 12A to the left side and to the center axis of the cup part 12. In a peripheral wall of the cup part 12, engagement grooves 15 are formed at two positions defined to have the same interval in the circumferential direction of the peripheral wall of the cup part 12 (i.e., at two positions apart by 180 degrees with respect to each other in the circumferential direction). Each engagement groove 15 is formed by cutting the peripheral wall of the cup part 12 from the right end periphery so that the engagement groove 15 faces the receiving part 12C. Each engagement groove 15 is formed to extend to the left side from the right end periphery of the cup part 12, and the deepest part (i.e., the left end part) of the engagement groove 15 is situated at the central position in the width direction of the cup part 12. The engagement grooves 15 and the receiving part 12C are located on the left side of the annular right end surface 12A, and are located inside the outer perimeter of the right end surface 12A.

In the vicinity of the right end periphery of the cup part 12, the groove width of each engagement groove 15 is formed to become narrower at a point closer to the left side. On the left side of the vicinity of the right end periphery of the cup part 12, the groove width of each engagement groove 15 has approximately the constant size. Specifically, as shown in FIG. 1A, each engagement groove 15 is defined by a pair of groove walls 15A and 15B which face with each other in the circumferential direction of the cup part 12. The groove wall 15A which is situated on the downstream side of the groove wall 15B in the clockwise direction (which is the same as the rotation direction of the after-mentioned cartridge joint unit 6) when viewed from the right side in FIG. 1A is formed to extend straightly to the left side. The groove wall 15B which is situated on the upstream side in the clockwise direction is formed to extend in parallel with the groove wall 15A on the left side of the vicinity of the right end periphery of the cup part 12, and the groove wall 15B is bent and extends to become father from the groove wall 15A toward the right side in the vicinity of the right end periphery of the cup part 12. The deepest part of each engagement groove 15 is rounded to have a circular shape protruding toward the left side.

Hereafter, a supporting relationship between the rotation body 4, the cartridge transmission unit 5 and the cartridge joint unit 6 is explained.

Referring to FIG. 1A, the right end part of the rotation shaft 4A of the rotation body 4 is inserted into the inner space of the left fitting part 7 of the cartridge transmission unit 5 from the left side through the opening 7A. In this state, the rotation shaft 4A of the rotation body 4 is joined to the cartridge transmission unit 5 so as not to be rotatable with respect to each other. Therefore, for example, the right end part of the rotation shaft 4A may be pressed into the inner space of the left fitting part 7.

In this state, the rotation body 4 and the cartridge transmission unit 5 are jointed integrally and coaxially, and are able to rotate together. That is, the center axis of the rotation body 4 and the center axis of the cartridge transmission unit 5 are arranged on a common axis. In this case, the center axis of the cartridge transmission unit 5 is defined as a rotation axis A, and the rotation body 4 and the cartridge transmission unit 5 are able to rotate about the rotation axis A (see FIG. 3C). As shown in FIG. 1A, the right end surface of the right fitting part 8 and the receiving part 9 (including the recessions 10) of the cartridge transmission unit 5 are exposed on the right side.

The ball part 11 of the cartridge joint unit 6 is fitted into the receiving part 9 from the right side (see FIG. 1C). Specifically, a spherical part of the ball part 9 other than the protrusions 13 is fitted into a circular recessed part of the receiving part 9 other than recessions 10 to have a certain allowance, and each protrusion 13 is fitted into a corresponding one of the recessions 10 to have a certain allowance (see FIG. 1C). Since each protrusion 13 is fitted into the corresponding recession 10, the cartridge transmission unit 5 and the cartridge joint unit 6 are joined together so as not to be rotatable with respect to each other, and are able to rotate together. In other words, the cartridge joint unit 6 is supported by the receiving part 9 of the cartridge transmission unit 5.

In this state, a first restriction member 16 having a shape of a semicircular arc protruding toward the front side and a second restriction member 17 having a shape of a semicircular arc protruding toward the rear side are attached to the right end surface of the right fitting part 8 from the right side. In this state, since the first and second restriction members 16 and 17 are unified, they form an annular shape having an outer diameter equal to the outer diameter of the right end surface of the right fitting part 8 when viewed from the right side (see FIG. 1B). As a result, the first and second restriction members 16 and 17 are placed between the right fitting part 8 and the cup part 12 of the cartridge joint unit 6 while surrounding the ball part 11 from the right side. Therefore, in the state where the cartridge 1 is completed as shown in FIG. 1B, rightward movement of the ball part 11 is restricted by the unified first and second restriction members 16 and 17. Therefore, the ball part 11 is prevented from being detached toward the right side from the receiving part 9 (see FIG. 1A).

As described above, in the state where the cartridge 1 is completed, the ball part 11 (including the protrusions 13) of the cartridge joint part 6 is fitted into the receiving part 9 (including the recessions 10) to have a certain allowance (see FIG. 1C). Further, the inner perimeter on the right end surface of the unified first and second restriction members 16 and 17 having the annular shape is chamfered. Hereafter, the chamfered part of the inner perimeter of the unified first and second restriction members 16 and 17 is referred to as a chamfered part 19 (see FIG. 1A).

As shown in FIG. 1C, the cartridge joint unit 6 is able to swing with respect to the ball part 11 within a range of the allowance and within a range defined not to contact the chamfered part 19. Specifically, the cartridge joint unit 6 is able to swing with respect to Y-axis which is orthogonal to X-axis defining the center axis (the rotation axis A) of the cartridge transmission unit 5 (the rotation body 4), and with respect to Z-axis which is orthogonal to both of X-axis and Y-axis. It should be noted that, in FIG. 3C, a movable range J of the cartridge joint unit 6 with respect to Y-axis is illustrated.

Referring to FIG. 1C, the cartridge joint unit 6 is able to rotate together with the cartridge transmission unit 5 in the state where the cartridge joint unit 6 has swung with respect to the cartridge transmission unit 5. In other words, the cartridge joint unit 6 is able to rotate about a rotation axis B which is allowed to intersect with the rotation axis A of the cartridge transmission unit 5 (see FIG. 3C). The rotation axis B is equal to the center axis of the cartridge joint unit 6.

In order to allow the cartridge joint unit 6 to smoothly rotate in the state where the cartridge joint unit 6 has swung with respect to the cartridge transmission unit 5, a lubricating oil having a relatively high viscosity, such as a grease, is applied to the receiving part 9 (see FIG. 1A) which receives the ball part 11 to be defined as the center of swinging of the cartridge joint unit 6. Since the first and second restriction members 16 and 17 are attached to the right end surface of the right fitting part 8 (see FIG. 1B), the receiving part 9 is hidden behind the back of the first and second restriction members 16 and 17, and therefore the grease of the receiving part 9 is prevented from being exposed to the outside (the right side) of the cartridge 1. Therefore, it becomes possible to prevent foreign matters from adhering to the grease in the receiving part 9 and thereby to prevent a user from soiling the user's hand with the grease in the receiving part 9 when the user handles the cartridge 1.

As shown in FIGS. 2A and 2B, a cover 18 may be attached to the casing 3 of the cartridge 1. With respect to the position shown in FIG. 2A, the cover 18 is formed to be a thin plate-like member in the width direction, and is formed such that a middle portion in the front and rear direction is bent to protrude toward the right side. Specifically, the cover 18 is formed to extend straightly from the front end toward the rear side, bends toward the right side at a right angle, bends further at right angle to extend toward the back side, and then bends at a right angle to extend toward the left side before finally bending at a right angle to extend toward the rear side. The cover 18 is fixed to the casing 3 at the front and rear end parts thereof, and almost the entire part of the cartridge transmission unit 5 is located inside the rightward projected middle part in the front and rear direction. With this structure, the cartridge transmission unit 5 is protected by the cover 18. The cover 18 may support subsidiary the cartridge transmission unit 5. It should be noted that some of the drawings are illustrated not to have the cover 18 for the sake of simplicity.

Hereafter, the device main body 2 is explained.

The device main body 2 defines an outer appearance of the image forming device 100, and has a box shape. In this embodiment, only a part of the device main body 2 relating to the feature of the embodiment is illustrated in the drawings for the sake of simplicity. Specifically, the device main body 2 includes an arm 20, a main body transmission unit 21 and a main body joint unit 22. The arm 20 has a plate member 23 which is formed to be thin in the width direction and to be long in the front and rear direction, and a cam member 24 provided on the right surface of the plate member 23. The plate member 23 and the cam member 24 are integrally provided.

In the plate member 23, a long hole 25 is formed to extend vertically and to penetrate the plate member 23 in the width direction (see FIGS. 3A and 3B). When viewed from the right side, the cam member 24 has an annular shape elongated in the front and rear direction that is similar to the shape of the long hole 25. The cam member 24 is formed to protrude toward the right side while surrounding the long hole 25. Therefore, when viewed from the right side, the long hole 25 is positioned inside the cam member 24. As shown in FIG. 2A, when viewed from the upper side, the right end surface of the cam member 24 has a first end surface 26 formed to be flat in the front and rear direction while being protruded toward the right side, a slanting surface 27 slanting straight from the rear end of the first end surface 26 toward the left and rear side, and a third end surface 28 formed to be flat in the front and rear direction while extending from the rear end of the slanting surface 27 toward the rear side.

The arm 20 is supported by the device main body 2. In the state shown in FIG. 2A, the arm 20 is able to reciprocate in the front and rear direction. For example, the reciprocating motion of the arm 20 is in cooperation with opening and closing of a door (not shown) provided to cover an attaching and detaching opening for the cartridge 1 on the device main body 2.

Referring to FIG. 3B, the main body transmission unit 21 is formed to be a thin circular plate in the width direction, and includes a gear part 29 formed to have gear teeth on a circumferential surface thereof, and a rod-like shaft part 30 protruding toward the left side from the circle center of the gear part 29. The gear part 29 and the shaft part 30 are integrally formed.

At the circle center on the right end surface of the gear part 29, a recession 31 is formed to be recessed toward the left side. The recession 31 is formed to have a cylindrical shape having the center axis passing through the circle center of the gear part 29 so that the recession 31 penetrates the gear part 29 and is recessed to the inside of the shaft part 30.

The shaft part 30 is formed to be a hollow cylinder which is elongated in the width direction and has the center axis passing through the circle center of the gear part 29. The hollow part of the shaft part 29 forms a part of the recession 31. The shaft part 30 has a root part 32, a middle part 33 and a tip part 34.

Figure 4A:
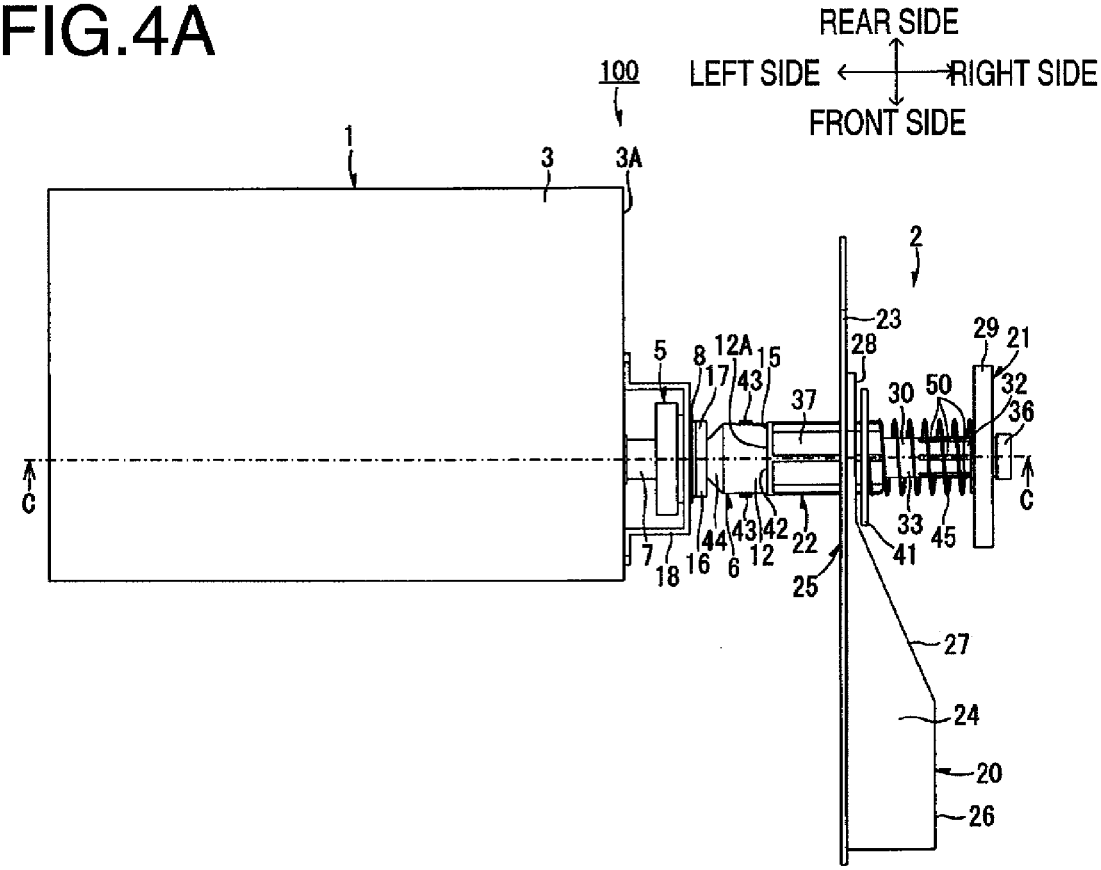
FIG. 4A illustrates a situation where the main body joint unit is situated at an advanced position with respect to the state shown in FIG. 2A.
Figure 4B:
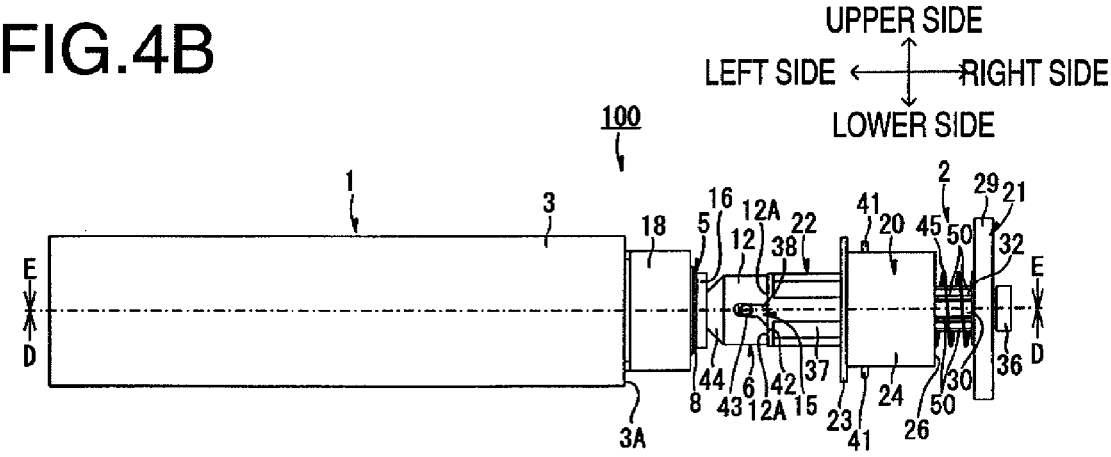
FIG. 4B illustrates a situation where the main body joint unit is situated at the advanced position with respect to the state shown in FIG. 2B.

The root part 32 is a right side part of the shaft part 30 (i.e., a part connected to the gear part 29). On the outer circumferential surface of the root part 32, a plurality of ribs 50, each of which protrudes outward in the radial direction of the root part 32 and extends in the left and right direction, are integrally formed to have constant intervals in the circumferential direction of the circumferential surface of the root part 32 (see FIGS. 4A and 4B also). The outer diameter of the root part 32 means a two-fold value of a distance between the circle center of the root part 32 (i.e., the shaft part 30) and a tip end of each rib 50 (i.e., the outer edge in the radial direction).

The middle part 33 is continuously formed with respect to the left side of the root part 32. The outer diameter of the middle part 33 is slightly smaller than the outer diameter of the root part 32, and is approximately constant in the entire width direction (see FIG. 3A also).

The tip part 34 has a spherical shape, and is continuously formed with respect to the left side of the middle part 33. The outer diameter of the tip part 34 is approximately equal to the outer diameter of the root part 32 and is slightly larger than the outer diameter of the middle part 33. On the outer circumferential surface of the tip part 34, protrusions 35 are integrally formed at positions defined to have the constant intervals in the circumferential direction which is defined with respect to a center point corresponding to the center axis of the shaft part 30 (i.e., at positions shifted by 180 degrees with respect to each other in the circumferential direction). Each of the protrusions 35 is formed to protrude outward in the radial direction which is defined with respect to the center point corresponding to the center axis of the shaft part 30.

The above described main body transmission unit 21 is supported by the device main body 2 such that the shaft part 30 is situated inside the cam member 24. Specifically, the device main body 2 is provided with a pin 36 which is a slender circular cylinder elongated toward the left side, and the pin 36 is inserted into the recession 31 of the main body transmission unit 21. With this structure, the main body transmission unit 21 is rotatably supported by the pin 36 of the device main body 2.

In the device main body 2, a motor (not shown) serving as a driving source is provided. Gear teeth of a gear attached to an output shaft of the motor engages with the gear teeth of the outer circumferential surface of the gear part 29. Therefore, when the motor is driven and the output shaft of the motor is rotated by the driving force of the motor, the main body transmission unit 21 rotates in a predetermined direction while receiving the driving force via the gear part 29. In this case, the rotation axis of the main body transmission unit 21 is equal to the center axis of the main body transmission unit 21 and the center axis of the pin 36, and is defined as a rotation axis C as shown in FIG. 3C.

The main body joint unit 22 has a shape of a hollow cylinder having the center axis (which is defined as a rotation axis D as shown in FIG. 3C) extending in the width direction, and is formed to be elongated in the width direction. The main body joint unit 22 has a root part 37 on the right side and a tip part 38 on the left side. The root part 37 and the tip part 38 are integrally formed. The tip part 38 serves as a fitting part.

At the circle center of the right end surface of the main body joint unit 22 (the root part 37), a recession 39 is formed to be recessed toward the left side. The recession 39 is formed to have a cylindrical shape having the center axis equal to the center axis of the main body joint unit 22. That is, the recession 39 penetrates the root part 37 in the width direction, and is recessed to the inside of the tip part 38.

The root part 37 is formed to be a hollow cylinder having the center axis (equal to the center axis D) extending in the width direction, and the hollow part of the root part 37 forms a part of the recession 39. The root part 37 is formed to have a constant outer diameter and a constant inner diameter throughout the width direction. The outer diameter of the root part 37 is approximately equal to the outer diameter of the cup part 12 of the cartridge joint unit 6. The inner diameter of the root part 37 is approximately equal to the outer diameters of the root part 32 and the tip part 34 of the shaft part 30.

As shown in FIG. 3B, on the inner surface of the root part 37, guide grooves 40 are formed to extend straight in the left and right direction at positions having the constant interval in the circumferential direction of the root part 37 (i.e., positions shifted by 180 degrees with respect to each other in the circumferential direction). Each guide groove 40 is formed such that the inner face is continuously formed to the recession 39 and the right end of each guide groove 40 is exposed on the right side from the right end surface of the main body joint unit 22 (the root part 37).

At a position slightly shifted to the left side from the right periphery on the outer circumferential surface of the root part 37, a jaw part 41 is integrally formed to protrude outward in the radial direction of the root part 37. Referring to FIG. 3A, the outer diameter of the jaw part 41 is larger than the maximum size of the cam member 24 of the arm 20 in the up and down direction.

The tip part 38 is formed to be a hollow cylinder having the center axis equal to the center axis of the root part 37, and the hollow part of the tip part 38 forms a part of the recession 39. It should be noted that the tip part 38 may be formed not to be a hollow cylinder, but to be a solid cylinder. The inner diameter of the tip part 38 is approximately equal to the inner diameter of the root part 37. The outer diameter of the tip part 38 is smaller than the outer diameter of the root part 37, and is approximately equal to the inner diameter of the cup part 12 of the cartridge joint unit 6. Each of the inner and outer diameters of the tip part 38 is substantially constant throughout the width direction of the tip part 38.

Since the outer diameter of the tip part 38 is smaller than the outer diameter of the root part 37, the right end periphery of the tip part 38 and the left end periphery of the root part 37 are connected via a joint surface 42 which has a flat shape in a direction orthogonal to the center axis (i.e., the rotation axis D) of the main body joint unit 22 (see FIG. 3C). The joint surface 42 has an annular shape surrounding the tip part 38 when viewed from the left side.

As shown in FIG. 3B, at the left end on the outer circumferential surface of the tip part 38, protrusions 43 are integrally formed to protrude outward in the radial direction of the tip part 38 at two positions which are defined to have the constant intervals in the circumferential direction of the tip part 38 (i.e., positions shifted by 180 degrees with respect to each other in the circumferential direction having the center corresponding to the center axis of the tip part 38). In the width direction, the protrusions 43 are located at the same position. The radial direction having the center corresponding to the center axis of the tip part 38 is a direction orthogonal to the rotation axis D (see FIG. 3C).

At the left end of the tip part 38, a guide part 44 is integrally formed. The guide part 44 has a petrosal shape tapering toward the left side. The guide part 44 may be formed to be a hollow cone or a truncated cone. The hollow part of the guide part 44 forms the left end of the recession 39. The center axis of the guide part 44 is equal to the center axis of the tip part 38. The maximum outer diameter of the guide part 44 is approximately equal to the outer diameter of the tip part 38.

The main body joint unit 22 is supported by the main body transmission unit 21. Specifically, the shaft part 30 of the main body transmission unit 21 is inserted into the recession 39 of the main body joint unit 22. In this state, each protrusion 35 of the tip part 34 of the shaft part 30 is fitted into the corresponding one of the guide grooves 40 to have a certain allowance in the main body joint unit 22 (see FIG. 3B). Therefore, by guiding each protrusion 35 along the guide groove 40 in the left and right direction, the main body joint unit 22 is able to move relative to the main body transmission unit 21 in the state where the main body joint unit 22 is supported by the main body transmission unit 21.

Hereafter, the most rightward position of the main body joint unit 22 is referred to as a retracted position (see FIGS. 2A-2B and 3A-3C), and the most leftward position of the main body joint unit 22 is referred to as an advanced position (see FIGS. 4A-4B and 5A-5B).

When the main body joint unit 22 is situated at the retracted position, almost the entire part of the shaft part 30 of the main body transmission unit 21 is accommodated in the recession 39 of the main body joint unit 22. In this case, each protrusion 35 of the tip part 34 of the shaft part 30 is situated at the left end of the corresponding guide groove 40 of the main body joint unit 22.

Since, as described above, the inner diameter of the root part 37 of the main body joint unit 22 is approximately equal to the outer diameters of the root part 32 and the tip part 34 of the shaft part 30, the shaft part 30 is fitted into the recession 39 of the main body joint unit 22 situated at the retracted position, with almost no gap being formed with respect to the recession 39 at two positions respectively corresponding to the root part 32 and the tip part 34 in the width direction.

Therefore, the main body joint unit 22 situated at the retracted position is stably supported by the shaft part 30 in a stationary state, without shaking with respect to the shaft part 30 of the main body transmission unit 22.

Figure 5A:
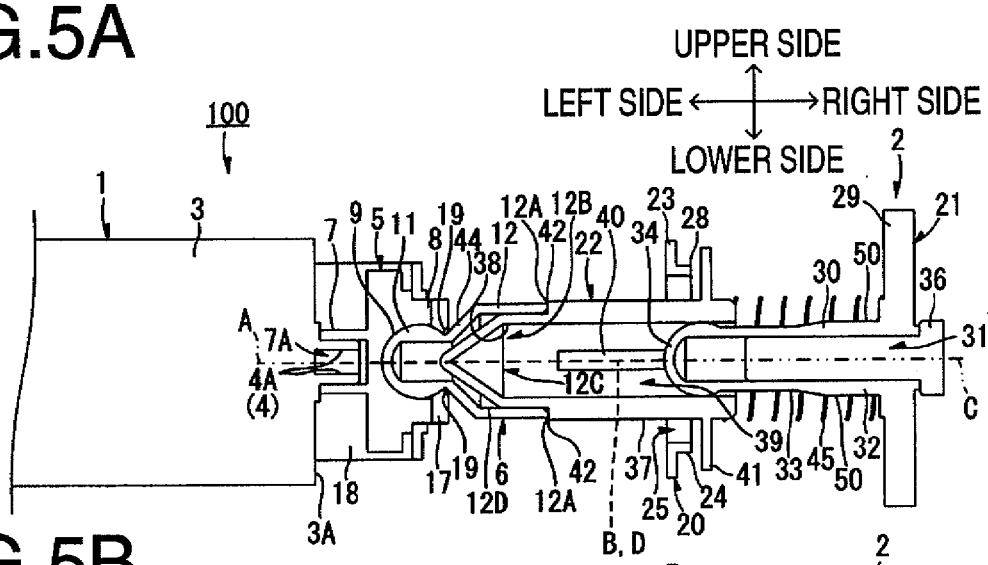
FIG. 5A is a cross section viewed along a line C-C shown in FIG. 4A.
Figure 5B:
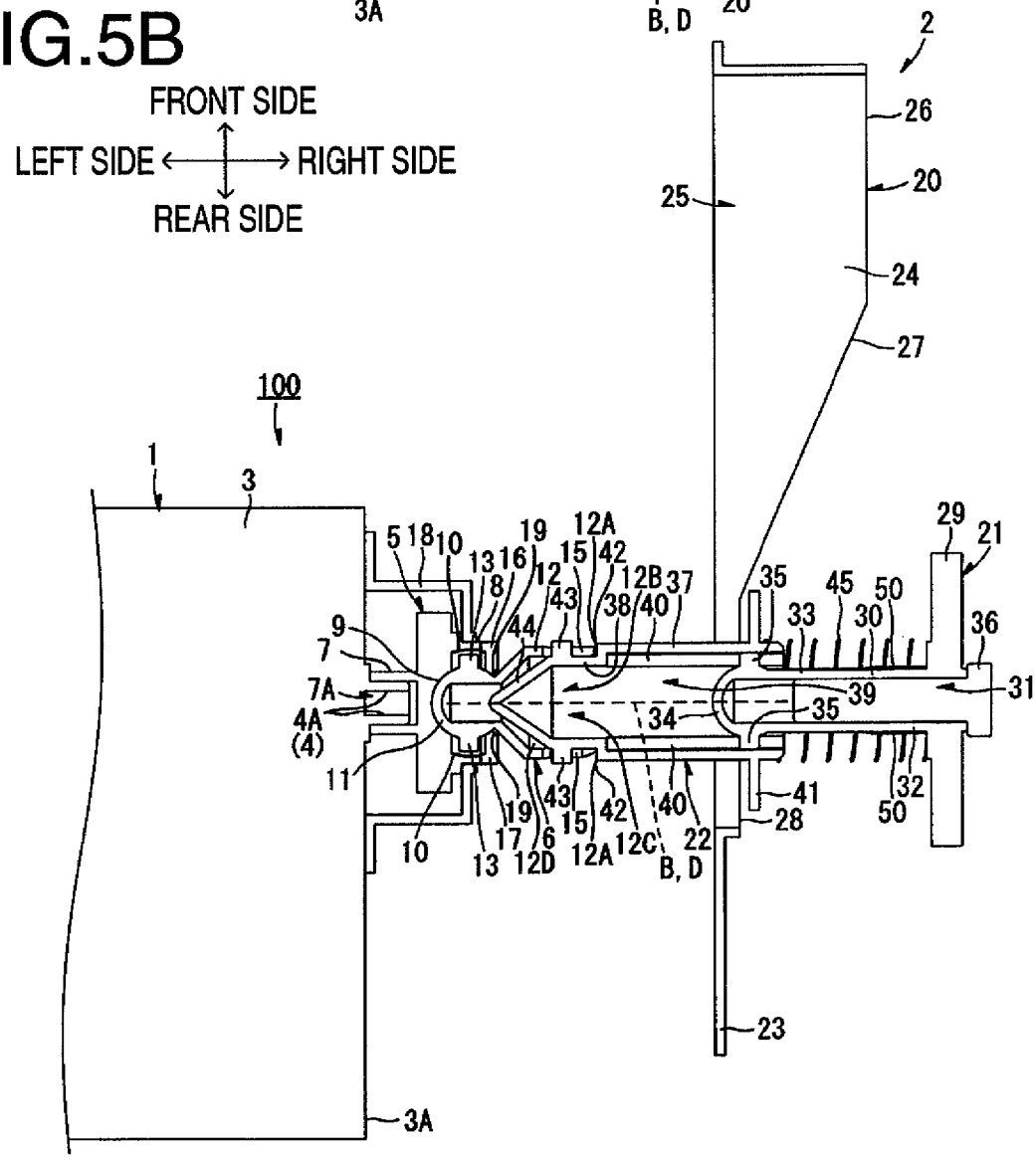
FIG. 5B is a cross section viewed along a line D-D shown in FIG. 4B.

As shown in FIGS. 5A and 5B, when the main body joint unit 22 is situated at the advanced position, only the tip part 34 and the left end of the middle part 33 of the shaft part 30 of the main body transmission unit 21 are accommodated in the recession 39 of the main body joint unit 22. In this case, each protrusion 35 of the tip part 34 of the shaft part 30 is situated at the right end of the corresponding guide groove 40 in the main body joint unit 22 (see FIG. 5B).

Referring to FIG. 5A, the shaft part 30 is fitted to the recession 39 of the main body joint unit 22 situated at the advanced position, with almost no gap being formed in the radial direction with respect to the recession 39, only at the tip part 34. That is, the shaft part 30 of the main body transmission unit 21 is fitted to the recession 39 of the main body joint unit 22 only at one portion. Therefore, the main body join unit 22 situated at the advanced position is able to swing freely with respect to the tip part 34 of the shaft part 30. Specifically, the main body joint unit 22 is able to swing within a range where the right end of the inner surface of the root part 37 (i.e., a right side part of the root part 37 with respect to the tip part 34 of the shaft part 30) does not contact the outer circumferential surface of the middle part 33 of the shaft part 30 of the main body transmission unit 21.

At each of the retracted position and the advanced position, each protrusion 35 of the tip part 34 of the shaft part 30 of the main body transmission unit 21 fits into the corresponding guide groove 40 of the main body joint unit 22 (see FIGS. 3B and 5B). Therefore, as described above, when the main body transmission unit 21 receives the driving force from the motor (not shown) and thereby rotates in the predetermined direction, the main body joint unit 22 also rotates together with the main body transmission unit 21. The main body joint unit 22 is able to rotate while swinging. That is, the main body joint unit 22 is able to rotate about the rotation axis D which is allowed to intersect with the rotation axis C of the main body transmission unit 21 (see FIGS. 6A and 6B). The rotation axis D is equal to the center axis of the main body joint unit 22.

As shown in FIGS. 3A and 3B, between the gear part 29 of the main body transmission unit 21 and the jaw part 41 of the main body joint unit 22, a spring 45 is located in a compressed state in the left and right direction. The spring 45 is a coil spring, and is fitted to both of the shaft part 30 of the main body transmission unit 21 and the root part 37 of the main body joint unit 22 (i.e., the right part with respect to the jaw part 41). Since the spring 45 is in the compressed state, the spring 45 constantly produces a force to extend in the left and right direction. Since the main body transmission unit 21 is fixed in the width direction with respect to the device main body 2 and the main body joint unit 22 is able to move freely relative to the main body transmission unit 21, the main body joint unit 22 is constantly pressed leftward to move to the advanced position by the spring 45.

As described above, in the main body joint unit 22 supported by the main body transmission unit 21, the left side part of the jaw part 41 is located inside the cam member 24 of the arm 20 and the long hole 25. In this state, the jaw par 41 is hooked to the right end surface of the cam member 24 from the right side.

As shown in FIGS. 3A and 3B, when the jaw part 41 is hooked to the first end surface 26 of the cam member 24 from the right side, the main body joint unit 22 is at the retracted position. When the arm 20 slides frontward in this state, the jaw part 41 of the main body joint unit 22 is passed from the first end surface 26 to the slanting surface 27 of the cam member 24, so that the main body joint unit 22 proceeds to the slanting surface 27. When the arm 20 is further slides frontward and thereby the jaw part 41 is passed from the slanting surface 27 to the second end surface 28, the jaw part 41 is hooked to the second end surface 28 and thereby the main body joint unit 22 is situated at the advanced position as show in FIGS. 5A and 5B. Strictly, the main body joint unit 22 is situated at the advanced position in the state where the jaw part 41 is not hooked to the second end surface 28 (i.e., in the state where the jaw part 41 is slightly lifted toward the right side from the second end surface 28).

On the other hand, by sliding the arm 20 to the rear side in the state where the main body joint unit 22 is situated at the advanced position, the main body joint unit 22 can be returned to the retracted position shown in FIGS. 3A and 3B.

Hereafter, attaching and detaching of the cartridge 1 with respect to the device main body 2 is explained.

First, attaching of the cartridge 1 is explained. When the door (not shown) of the device main body 2 is opened for attaching the cartridge 1, the arm 20 slides to the rear side in cooperation with the opening motion of the door, and the main body joint unit 22 is situated at the retracted position shown in FIGS. 3A and 3B.

In this state, the cartridge 1 is attached to the device main body 2 through the attaching and detaching opening of the device main body 2. When the attaching of the cartridge 1 is finished, the circular hole 12B of the cup part 12 of the cartridge joint unit 6 faces, from the left side, the tip part 38 and the guide part 44 of the main body joint unit 22 situated at the retracted position. It is understood that the direction toward the left side is equal to the direction approaching the cartridge joint unit 6, and that the left end of the tip part 38 is an end on the cartridge 1 side.

As described above, the swinging range of the cartridge joint unit 6 is defined. Therefore, even if the cartridge joint unit 6 swings at the maximum as shown in FIG. 3C, the circular hole 12B of the cup part 12 is able to face, from the left side, the tip part 38 and the guide part 44 of the main body joint unit 22 at the retracted position.

Referring to FIGS. 3A and 3B, when a user starts to close the door (not shown) after finishing the attaching of the cartridge 1, the arm 20 slides frontward in cooperation with the closing motion of the door, and thereby the main body joint unit 22 starts to move from the retracted position. In this case, the guide part 44 and the tip part 38 passes the circular hole 12B of the cup part 12 in this order, and are fitted into the receiving part 12C of the cup part 12 along the rotation axis B of the cartridge joint unit 6 (see FIG. 5). That is, the guide part 44 and the tip part 38 of the main body joint unit 22 are received by the receiving part 12C of the cup part 12. At this time, each protrusion 43 of the tip part 38 is fitted into the corresponding engagement groove 15 from the right side. That is, each protrusion 43 engages with the corresponding engagement groove 15.

Since the groove width of each engagement groove 15 is formed to become narrower toward the left side around the right end position (i.e., the groove width becomes wider at a point closer to the right end), each protrusion 43 is able to smoothly fit into the corresponding engagement groove 15.

Even when the cartridge joint unit 6 has swung at the maximum as shown in FIG. 3C, the guide part 44 is received by the receiving par 12C of the cup part 12 prior to the tip part 38 if the main body joint unit 22 starts to move toward the left side from the retracted position. In this case, since the outer circumferential surface of the guide surface 44 contacts the right end periphery (i.e., the slanting surface 14) of the inner surface 12D of the cup part 12, the swinging position of the cartridge joint unit 6 is changed so that the circular hole 12B of the cup part 12 faces the guide part 44. Consequently, the tip part 38 following the guide part 44 is received smoothly by the receiving part 12C.

When the door has closed completely, the main body joint unit 22 is situated at the advanced position shown in FIGS. 5A and 5B. In this case, each protrusion 43 of the tip part 38 reaches the vicinity of the deepest position (i.e., the left end) of the corresponding engagement groove 15 of the cup part 12 (see FIG. 4B), and the entire outer circumferential surface of the tip part 38 (other than the protrusions 43) contacts the inner surface 12D of the cup part 12 from the inside in the radial direction of the cup part 12. Further, the center axis (the rotation axis B) of the cartridge joint unit 6 and the center axis (the rotation axis D) of the main body joint unit 22 are located on the common straight line to be located coaxially with respect to each other.

That is, in the state where the cartridge 1 has been attached to the main body 1 and the main body joint unit 22 has been situated at the advanced position, the cartridge joint unit 6 and the main body joint unit 22 are connected with each other such that the rotation axis B of the cartridge joint unit 6 and the rotation axis D of the main body joint unit 22 are located on the common straight line. In this state, the right end surface 12A of the cup part 12 of the cartridge joint unit 6 and the joint surface 42 of the tip part 38 of the main body joint unit 22 faces and contacts with respect to each other in the width direction.

In the state where the cartridge 1 has been attached to the device main body 2 and the cartridge 1 is in a normal position, the center axes (the rotation axes A, B, C and D) of the cartridge transmission unit 5, the cartridge joint unit 6, the main body joint unit 22 and the main body transmission unit 21 are located coaxially with respect to each other if the center axis (the rotation axis A) of the cartridge transmission unit 5 and the center axis (the rotation axis C) of the main body transmission unit 21 are located coaxially with respect to each other. In this state, when the main body transmission unit 21 rotates while receiving the driving force from the motor (not shown), the cartridge transmission unit 5, the cartridge joint unit 6 and the main body joint unit 22 are able to rotate about the common rotation axis of the main body transmission unit 21. In this case, since the driving force is transmitted in order of the main body transmission unit 21→the main body joint unit 22→the cartridge joint unit 6→the cartridge transmission unit 5, it can be expressed that the cartridge joint unit 6 rotates the cartridge transmission unit 5.

In the cartridge 1, when the cartridge transmission unit 5 rotates, the driving force from the motor is transmitted to the rotation body 4 to which the cartridge transmission unit 5 is coupled. Consequently, the rotation body 4 also rotates.

Figure 6A:
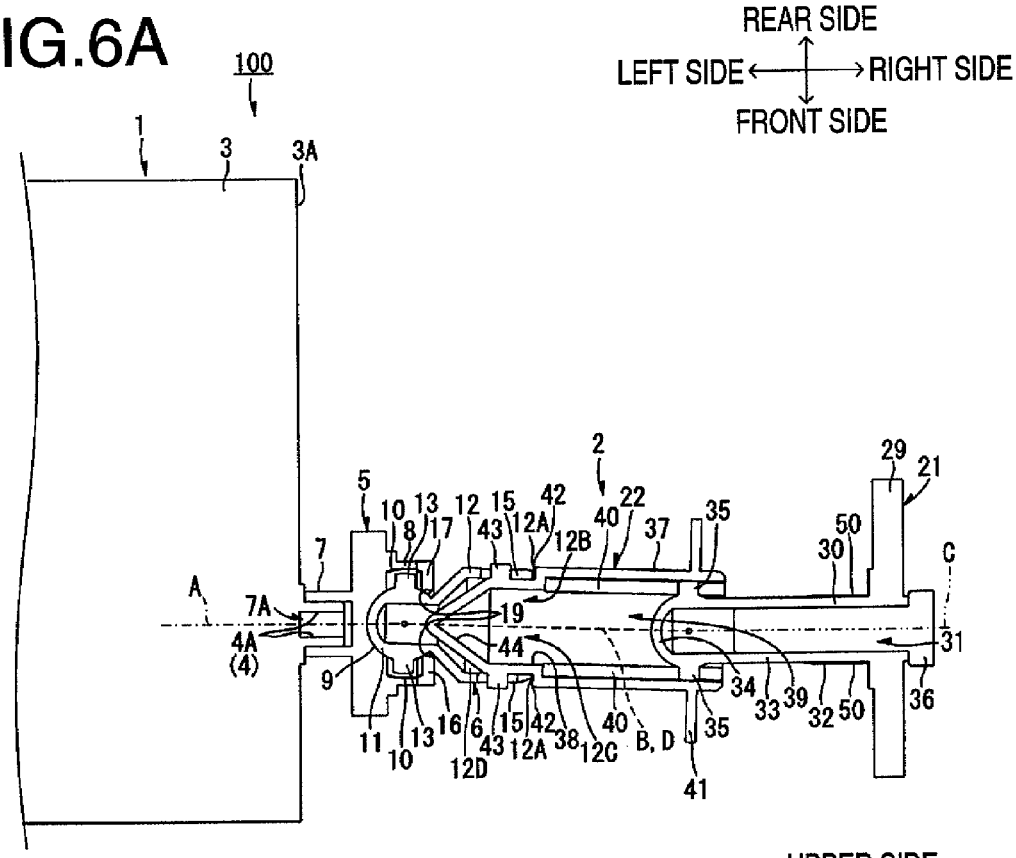
FIG. 6A illustrates a situation where the cartridge joint unit and the main body joint unit swing about Z-axis shown in FIG. 1C in a cross section viewed along a line E-E shown in FIG. 4B.
Figure 6B:
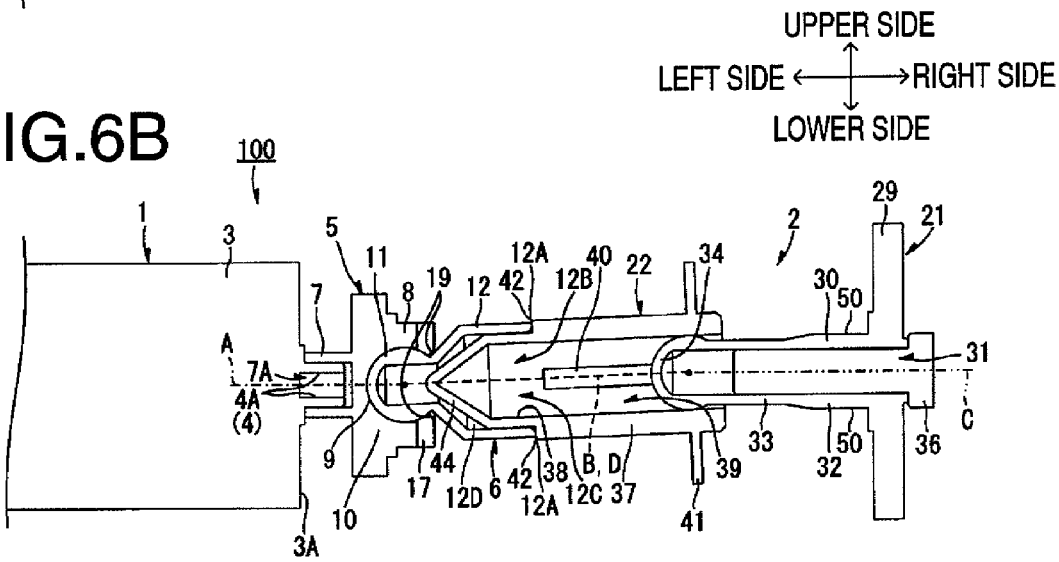
FIG. 6B illustrates a situation where the cartridge joint unit and the main body joint unit swing about Y-axis shown in FIG. 1C in the state shown in FIG. 5A.

However, there is a case where the cartridge 1 attached to the device main body 2 is shifted from the normal position. In this case, the rotation axis A of the cartridge transmission unit 5 is not coaxially located with respect to the rotation axis C of the main body transmission unit 21 as shown in FIGS. 6A and 6B. In FIG. 6A, the rotation axis A of the cartridge transmission unit 5 is shifted to the rear side with respect to the rotation axis C of the main body transmission unit 21. In FIG. 6B, the rotation axis A of the cartridge transmission unit 5 is shifted to the lower side with respect to the rotation axis C of the main body transmission unit 21. Further, due to structural reasons, there may be a case where the rotation axis A of the cartridge transmission unit 5 is not positioned coaxially with respect to the rotation axis C of the main body transmission unit 21 regardless of the fact that the cartridge 1 is situated at the normal position.

As described above, when the rotation axis A of the cartridge transmission unit 5 and the rotation axis C of the main body transmission unit 21 are not coaxially situated, the cartridge joint unit 6 and the main body joint unit 22 coaxially coupled (integrally coupled) swing about the ball unit 11 of the cartridge joint unit 6, and swing about the tip part 34 of the shaft part 30 of the main body transmission unit 21.

In FIG. 6A, the unified cartridge joint unit 6 and the main body joint unit 22 swing to the front side about the ball part 11 (i.e., about the Z-axis). That is, the side of the main body joint unit 22 of the unified cartridge joint unit 6 and the main body joint unit 22 has swung to the front side about the ball part 11. In other words, the side of the cartridge joint unit 6 of the unified cartridge joint unit 6 and the main body joint unit 22 has swung to the rear side about the tip part 34 of the axis part 30.

In FIG. 6B, the unified cartridge joint unit 6 and the main body joint unit 22 has swung to the upper side about the ball part 11 (i.e., about the Y-axis). That is, the side of the main body joint unit 22 of the unified cartridge joint unit 6 and the main body joint unit 22 has swung to the upper side about the ball part 11. In other words, the side of the cartridge joint unit 6 of the unified cartridge joint unit 6 and the main body joint unit 22 has swung to the lower side about the tip part 34 of the axis part 30.

By the above described swinging of the unified cartridge joint unit 6 and the main body joint unit 22, the rotation axis B of the cartridge joint unit 6 and the rotation axis D of the main body joint unit 22 intersect both of the rotation axis A of the cartridge transmission unit 5 and the rotation axis C of the main body transmission unit 21.

In this case, when the main body transmission unit 21 rotates, the cartridge transmission unit 5, the cartridge joint unit 6 and the main body transmission unit 22 rotate in the state where the rotation axis A and the rotation axis C are not coaxially situated and the coaxially situated rotation axes B and D intersect with both of the rotation axis A and the rotation axis C. As in the case where the cartridge 1 is situated at the normal position, the cartridge joint unit 6 rotates coaxially with respect to the main body joint unit 22, and rotates the cartridge transmission unit 5. Further, the rotation body 4 also rotates properly with rotation of the cartridge transmission unit 5.

That is, the unified cartridge joint unit 6 and the main body joint unit 22 serve as a joint by swinging. Therefore, by rotating while connecting the cartridge transmission unit 5 and the main body transmission unit 21 which are not coaxially situated, it becomes possible to transmit the driving force from the main body transmission unit 21 to the cartridge transmission unit 5.

Referring to FIG. 6A, since the cartridge join unit 6 and the main body joint unit 22 rotate in the state where the cartridge join unit 6 and the main body joint unit 22 have swung, the ball part 11 of the cartridge joint unit 6 might wear, and a contacting part of the main body joint unit 22 with respect to the tip part 34 of the shaft part 30 of the main body transmission unit 21 (namely, a contacting part of the guide groove 40 with respect to the protrusion 35 of the tip part 34) might wear. In addition, in this case, the protrusions 35 of the tip part 34 might wear.

In this regard, according to the embodiment, the cartridge joint unit 6 which might wear is formed as a part of the cartridge 1 which is a consumable. Therefore, even if the cartridge joint unit 6 has worn, the cartridge joint unit 6 is replaced with a new one each time the cartridge 1 is replaced with a new one. Therefore, the cartridge joint unit 6 which has a high frequently of replacement is not required to be made of hard-wearing material which is relatively expensive. That is, it is possible to form the cartridge joint unit 6 with inexpensive material. On the other hand, since the frequency of replacement of each of the main body joint unit 22 and the main body transmission unit 21 of the device main body 2 is low relative to the frequency of replacement of the cartridge joint unit 6. Therefore, the main body joint unit 22 and the main body transmission unit 21 need to be made of hard-wearing material.

In order to detach the cartridge 1 from the device main body 2, first the door is opened to move the main body joint unit 22 to the retracted position, and the jointed state of the cartridge joint unit 6 and the main body joint unit 22 is released (see FIGS. 3A and 3B). Thereafter, the cartridge 1 is withdrawn through the attaching and detaching opening (not shown).

Hereafter, the cartridge joint unit 6 is explained in detail with reference to FIGS. 7A-7C.

Figure 7A:
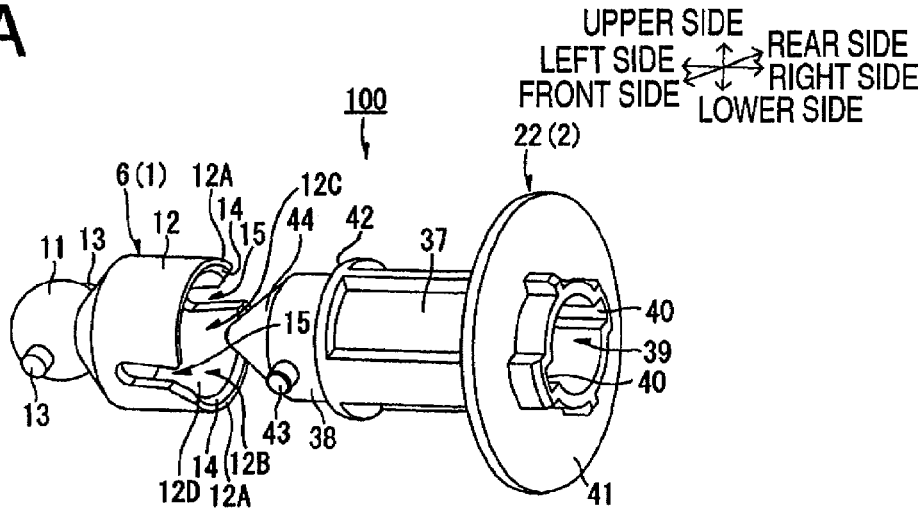
FIG. 7A is a perspective view illustrating the cartridge joint unit and the main body joint unit which are not coupled to each other.
Figure 7B:
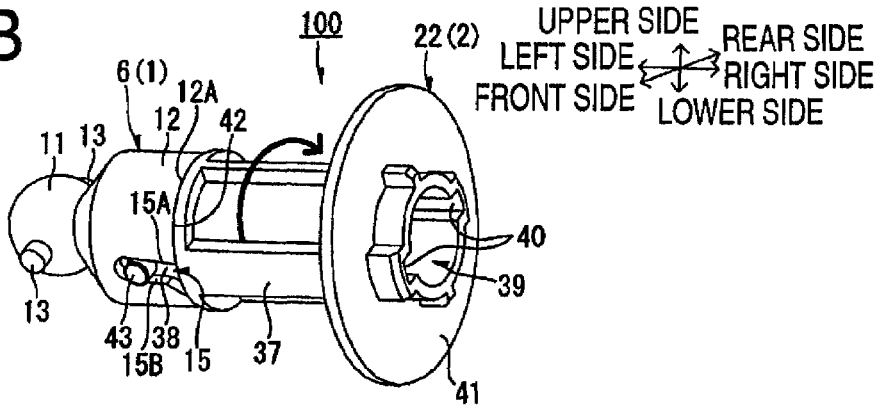
FIG. 7B illustrates a situation where the cartridge joint unit and the main body joint unit are coupled to each other.

As described above, when the main body transmission unit 21 receives the driving force from the motor and rotates, the coupled cartridge joint unit 6 and the main body joint unit 22 rotate in the clockwise direction, when viewed from the right side, as indicated by a bold arrow in FIG. 7B.

Each engagement groove 15 (i.e., the groove walls 15A and 15B of each engagement groove 15) formed in the peripheral wall of the cup part 12 is formed to be inclined to gradually shift to the rotation direction of the cartridge join unit 6, in regard to the extending direction from the right end toward the deepest part (the left end) of the engagement groove 15. Therefore, as shown in FIG. 7C, each engagement groove 15 is formed to be inclined to intersect with the rotation axis B when viewed from the outside in the radial direction of the cartridge joint unit 6.

When the coupled cartridge joint unit 6 and the main body joint unit 22 rotate as described above (see the bold arrow shown in FIG. 7B), each protrusion 43 fitted into the corresponding engagement groove 15 presses, toward the downstream side in the rotation direction of the cartridge joint unit 6, one of the groove walls 15A and 15B situated on the downstream side in the rotation direction of the cartridge joint unit 6 (i.e., the groove wall 15A). Referring to FIG. 7C, in this case, a pressing force P of the protrusion 43 acts on the groove wall 15A in the direction perpendicular to the slanting direction of the groove wall 15A. The pressing force P is divided into a component force Q pointing to the direction orthogonal to the rotation axis B of the cartridge joint unit 6 and a component force R pointing to the direction extending in parallel with the rotation axis B.

By the component force Q, the driving force is transmitted from the main body joint unit 22 to the cartridge joint unit 6, and thereby the cartridge joint unit 6 and the main body joint unit 22 are able to rotate together. On the other hand, by the component force R, the groove wall 15A (i.e., the cartridge joint unit 6 having the groove wall 15A) is attracted toward the main body joint unit 22. On the other hand, since the protrusion 43 tends to move to the left side along the slanting direction of the groove wall 15A due to the pressing force against the groove wall 15A, the main body joint unit 22 having the protrusions 43 is drawn toward the cartridge joint unit 6. As a result, the cartridge joint unit 6 and the main body joint unit 22 closely contact with each other, and thereby rotate together in a firmly unified state. As described above, when the main body transmission unit 21 rotates in the state where the cartridge joint unit 6 and the main body joint unit 22 are coupled to each other, the cartridge joint unit 6 and the main body joint unit 22 closely contact with each other.

Hereafter, action and advantages of the above described embodiment are explained.

(1) Referring to FIG. 3C, in the device main body 2 having the motor (not shown), the main body transmission unit 21 rotates about the rotation axis C while receiving the driving force from the motor, and the main body joint unit 22 which is supported by the main body transmission unit 21 rotates about the rotation axis D which is allowed to intersect with the rotation axis C, in accordance with rotation of the main body transmission unit 21.

On the other hand, in the cartridge 1 which includes the rotation body 4 and is configured to be detachably attachable to the device main body 2, the driving force of the motor is transmitted to the rotation body 4 through rotation of the cartridge transmission unit 5 about the rotation axis A, and the cartridge joint unit 6 supported by the cartridge transmission unit 5 is able to rotate about the rotation axis B which is able to intersect with the rotation axis A.

As shown in FIG. 5A, when the main body transmission unit 21 rotates in the state where the cartridge 1 has been attached to the device main body 2 and the cartridge joint unit 6 has been coupled to the main body joint unit 22, the cartridge joint unit 6 rotates coaxially with respect to the main body joint unit 22, and rotates the cartridge transmission unit 5. That is, in this case, the cartridge joint unit 6 rotates in the state where the rotation axis D of the main body joint unit 22 and the rotation axis B of the cartridge joint unit 6 are situated along the common straight line.

In other words, the cartridge joint unit 6 and the main body joint unit 22 which serve as a jointing portion between the cartridge 1 and the device main body 2 rotate integrally without moving relatively with respect to each other. Such a configuration eliminates the need for applying a lubricating oil, such as a grease, to the jointing portion between the cartridge 1 and the device main body 2 (i.e., the contacting part of the cup part 12 and the tip part 38 where the cartridge 1 and the device main body 2 are coupled). That is, the grease does not exist on the cartridge joint unit 6 which is exposed to the outside of the cartridge 1. Specifically, the grease does not exist in the cup part 12 contacting the main body joint unit 22 in the cartridge joint unit 6.

As a result, it becomes possible to prevent a user from soiling the user's hand or clothes with the grease when the user handles the cartridge 1, and to prevent foreign material from adhering to the grease and clogging the cartridge joint unit 6.

(2) The joint surface 42 which is orthogonal to the rotation axis D is provided in the main body joint unit 22 (see FIG. 3C), and the right end surface 12A which is orthogonal to the rotation axis B is provided in the cartridge joint unit 6 (see FIG. 1B also). Since the joint surface 42 and the right end surface 12A are in surface contact with each other in the state where the main body joint unit 22 and the cartridge joint unit 6 are coupled to each other, it becomes possible to rotate the main body joint unit 22 and the cartridge joint unit 6 in the state where the main body joint unit 22 and the cartridge joint unit 6 are coaxially coupled securely with respect to each other.

Figure 7C:
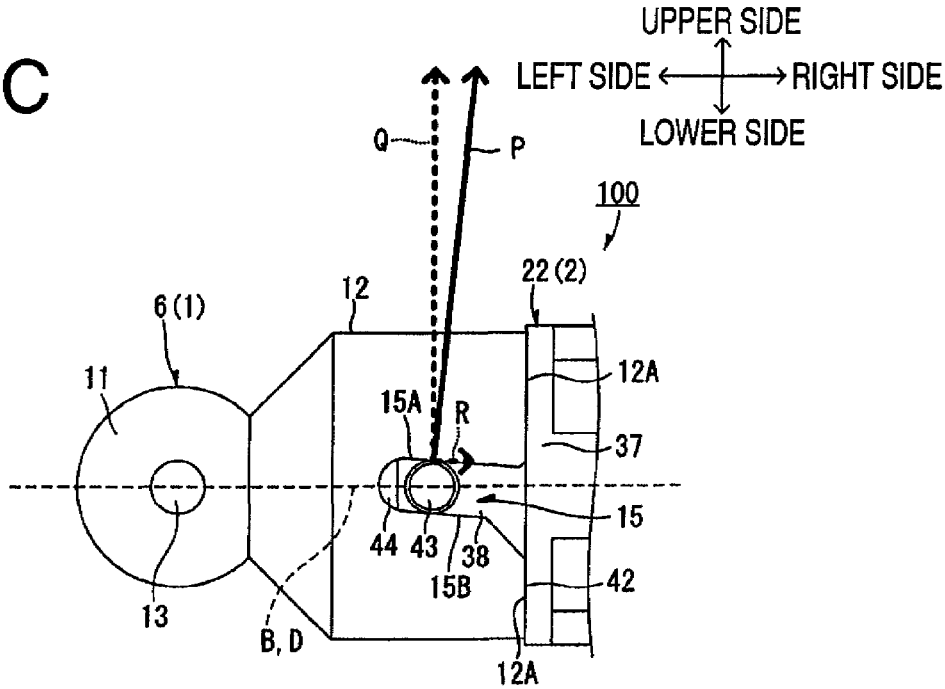
FIG. 7C is a front view illustrating a main part of the coupled cartridge joint unit and the main body joint unit.

(3) As shown in FIG. 7C, when the main body transmission unit 21 rotates in the state where the main body joint unit 22 and the cartridge joint unit 6 are coupled to each other, the main body joint unit 22 and the cartridge joint unit 6 closely contact with each other. Therefore, it is possible to keep the firmly coupled state of the main body joint unit 22 and the cartridge joint unit 6, and to rotate reliably and coaxially the main body joint unit 22 and the cartridge joint unit 6.

(4) As shown in FIG. 7A, the main body joint unit 22 has the tip part 38 and the protrusions 43 formed on the tip part 38 to protrude outward in the direction orthogonal to the rotation axis D (see FIG. 7C). On the other hand, the cartridge joint unit 6 is provided with the receiving part 12C having a concave shape and the engagement grooves 15 formed to face the receiving part 12.

Referring to FIG. 7C, when the main body joint unit 22 and the cartridge joint unit 6 are coupled to each other, the tip part 38 is received by the receiving part 12C (see FIG. 7A) along the rotation axis B, and the protrusion 43 engages with the engagement groove 15.

Since the engagement groove 15 is formed to be inclined to intersect the rotation axis B, the protrusion 43 presses the groove wall 15A of the engagement groove in the cartridge joint unit 6 in the direction orthogonal to the slanting direction of the engagement groove 15. In this case, the component force R defined in the direction of the rotation axis B of the pressing force B of the protrusion 43 draws the cartridge joint unit 6 toward the main body joint unit 22.

As a result, the main body joint unit 22 and the cartridge joint unit 6 closely contact with each other when the main body joint unit 22 and the cartridge joint unit 6 rotates.

(5) As shown in FIG. 7A, the guide part 44 having a petrosal shape tapering toward the cartridge joint unit 6 is provided at the tip of the tip part 38 on the side of the cartridge joint part 6, and is received by the receiving unit 12C prior to the tip part 38. Therefore, the tip part 38 following the guide part 44 is received by the receiving part 12C smoothly and securely.

(6) As shown in FIG. 3A, the receiving part 12C and the engagement grooves 15 are located on the side of the cartridge transmission unit 5 with respect to the right end surface 12A which is in surface contact with the joint surface 42, and are not situated on the outside of the cartridge 1 from the right end surface 12A. Therefore, the receiving part 12C and the engagement grooves 15 become hard to collide against external substances on the outside of the cartridge 1. As a result, it becomes possible to prevent the receiving part 12C and the engagement grooves 15 from being damaged by the external substances.

Hereafter, variations of the above described embodiment are explained. In the following, four variations for closely contacting the cartridge joint unit 6 with the main body joint unit 22 are described as first to fourth variations. In the following, to elements which are substantially the same as those of the above described embodiment, the same reference numbers are assigned and explanations thereof will not be repeated.

First Variation

A first variation is shown in FIGS. 8A to 8D. Referring to FIG. 8A, the tip part 38 of the main body joint unit 22 is formed to be a polygonal prism (e.g., a triangular prism in the first variation) extending along the rotation axis D of the main body joint unit 22 (see FIG. 8D). Therefore, when viewed as a cross section cut along a plane orthogonal to the rotation axis D, the cross section of the tip part 38 has a polygonal shape (e.g., a triangular shape in the first variation). On the tip part 38, a portion corresponding to each edge line 51 (i.e., each corner when viewed as a cross section) is rounded. The left half part of the tip part 38 is slightly twisted (e.g., by several degrees) toward the rotation direction of the main body joint unit 22 (i.e., the direction indicated by a bold arrow in FIG. 8B) in regard to a direction from the right side toward the left side, and is defined as a twisting part 52 which serves as a fitting part. At the left end of the twisting part 52, the guide part 44 is integrally provided. According to the polygonal shape of the tip part 38, the guide part 44 according to the first variation is formed to have a petrosal shape (e.g., a triangular pyramid in the first variation) tapering toward the left side (i.e., tapering toward the side of the cartridge joint unit 6), and to have a polygonal cross section. The advantages achieved by providing the guide part 44 are described in the embodiment. Similarly to the twisting part 52, the guide part 44 may be slightly twisted to the rotation direction of the main body joint unit 22.

A receiving part for receiving the twisting part 52 is formed in the inner space of the cup part 12 in accordance with the shape of the tip part 38. Specifically, the receiving part of the cup part 12 is formed to be similar to the shape of the twisting part 52 and to have the same cross section as that of the twisting part 52 so that the twisting part 52 is fitted into the receiving part of the cup part 12. Therefore, a fitting part 12E, where the inner surface 12D defining the receiving part 12C of the cup part 12 fits to the twisting part 52 in the state where the cartridge joint unit 6 is coupled to the main body joint unit 22, is also slightly twisted to the rotation direction of the main body joint unit 22, in regard to the direction from the right side toward the left side. That is, the fitting part 12E has a shape of a polygonal prism slightly twisted to the rotation direction of the main body joint unit 22.

A right side part (a guide surface 12F) of the fitting part 12E (i.e., on the side of the circular hole 12B) on the inner surface 12D is formed to have a cone shape becoming larger toward the right side.

According to the first variation, when the main body joint unit 22 proceeds to the left side toward the advanced position, the guide part 44 and the twisting part 52 of the tip part 38 passes the circular hole 12B in this order, and the guide part 44 of the tip part 38 is guided to the side of the fitting part 12E along the guide surface 12F. When the main body joint unit 22 reaches the advanced position along the rotation axis B of the cartridge joint unit 6 (see FIG. 8D), the twisting part 52 of the tip part 38 contacts the fitting part 12E, and is received by the receiving part 12C at the fitting part 12E, and is fitted into the receiving part 12C (see FIGS. 8C and 8D). As in the case of the above described embodiment, the guide part 44 is received by the receiving part 12C prior to the twisting part 52.

As shown in FIG. 8D, at the contacting part where the twisting part 52 and the receiving part 12C contact with each other, the slanting part which slants to intersect with the rotation axis B exists. Referring to the lower side of FIG. 8D with respect to the rotation axis B, when the fitting part 12E presses the twisting part 52 during rotation of the main body joint unit 22, a component force in the rotation axis B direction (i.e., the component force R shown in FIG. 7C) of the pressing force caused by the tip part 38 is produced, and the cartridge joint unit 6 is drawn to the main body joint unit 22.

As a result, it becomes possible to closely contact the main body joint unit 22 with the cartridge joint unit 6.

Further, in the cartridge joint unit 6, the receiving part 12C is located on the side of the cartridge transmission unit 5 (i.e., on the left side) with respect to the right end surface 12A which is in surface contact with the joint surface 42, and therefore the receiving part 12C does not protrude to the outside of the cartridge 1. Therefore, the receiving part 12C is hard to collide against external substances on the outside of the cartridge 1. As a result, it becomes possible to prevent the receiving part 12C from being damaged by external substances on the outside of the cartridge 1.

Second Variation

A second variation is shown in FIGS. 9A to 9C. As shown in FIGS. 9A to 9C, the tip part 38 of the main body joint unit 22 is formed to have a shape of a truncated cone tapering toward the left side (i.e., the side of the cartridge joint unit 6) and having the center corresponding to the rotation axis D of the main body joint unit 22 (se FIG. 9C). On the outer circumferential surface of the tip part 38, external teeth 53 are arranged in the circumferential direction thereof (i.e., the rotation direction of the main body joint unit 22 indicated by a bold arrow in FIG. 9B).

Referring to FIG. 9C, when viewed from the left side, the external teeth 53 are formed to extend outward in a radial pattern centering the rotation axis D, and each tooth 53 extends straight in parallel with the radial direction. In the cup part 12 of the cartridge joint unit 6, the receiving part 12C which is recessed to receive the tip part 38 along the rotation axis B of the cartridge joint unit 6 is similar to the tip part 38, and has a shape of a truncate cone. Accordingly, the inner surface 12D defining the receiving part 12C of the cup part 12 is formed to have a shape of a truncated cone tapering toward the left side (see FIG. 9A). On the inner surface 12D, internal teeth 54 are arranged in the circumferential direction thereof. When viewed from the right side, the internal teeth 54 are formed to extend in a radial pattern centering the rotation axis of the cup part 12 (i.e., the rotation axis B of the cartridge joint unit 6 shown in FIG. 9C), and each tooth 54 extends straight in parallel with the radial direction.

The internal teeth 54 and the receiving part 12C are located on the left side of the annular right end surface 12A of the cup part 12, and are positioned inside the outer perimeter of the right end surface 12A.

In the second variation, when the main body joint unit 22 reaches the advanced position and the main body joint unit 22 and the cartridge joint unit 6 are coupled to each other, the tip part 38 is received by the receiving part 12C along the rotation axis B to be fitted into the receiving part 12C of the cup part 12. In this case, the external teeth 53 of the tip part 38 engage with the internal teeth 54 of the cup part 12 (the receiving part 12C). That is, spline fitting is achieved between the external teeth 53 and the internal teeth 54.

If the main body joint unit 22 rotates in this state, the internal teeth 54 and the external teeth 53 engage firmly with each other. As a result, it becomes possible to closely contact the main body joint unit 22 with the cartridge joint unit 6.

In the cartridge joint unit 6, the receiving part 12C and the internal teeth 54 are located on the side of the cartridge transmission unit 5 with respect to the right end surface 12A (which is positioned at the outermost position) in surface contact with the joint surface 42, and do not protrude to the outside of the cartridge 1 from the right end surface 12A. Therefore, the internal teeth 54 are hard to collide against external substances on the outside of the cartridge 1. Consequently, it becomes possible to prevent the receiving part 12C and the internal teeth 54 from being damaged.

Third Variation

A third variation is shown in FIGS. 9D and 9E. As shown in FIGS. 9D and 9E, in contrast to the above described second variation, the external teeth 53 and the internal teeth 54 according to the third variation are formed to be twisted toward the circumferential direction having the center corresponding to the rotation axis B and the rotation axis D (i.e., the rotation direction of the cartridge joint unit 6 and the main body joint unit 22 as indicated by a bold arrow in FIG. 9B).

Referring to FIG. 9E, at a contacting portion between the external teeth 53 and the internal teeth 54, slanting parts are formed to intersect with the rotation axis B of the cartridge joint u nit 6 (i.e., the rotation axis D of the main body joint unit 22). Therefore, when the main body transmission unit 22 rotates and thereby the external teeth 53 presses the internal teeth 54, a component force (i.e., the component force R shown in FIG. 7C) pointing in the direction of the rotation axis B (rotation axis D) is produced based on a pressing force of the external teeth 53. As a result, the internal teeth 54 (i.e., the cartridge joint unit 6) are drawn to the main body joint unit 22.

Consequently, it becomes possible to more closely contact the main body joint unit 22 with the cartridge joint unit 6 during rotation thereof.

Fourth Variation

A fourth variation is shown in FIGS. 10A and 10B. In the fourth variation, the internal teeth 54 are formed on the inner surface 12D instead of forming the engagement grooves 15, and the external teeth 53 are formed on the outer circumferential surface of the tip part 38 instead of forming the protrusions 43 on the tip part 38. That is, the external teeth 53 are formed on the cylindrical outer surface of the tip part.

As in the case of each of the second and third variations, the receiving part 12C and the internal teeth 54 are located on the left side with respect to the annular right end surface 12A of the cup part 12. Further, when viewed from the right side, the receiving part 12C and the internal teeth 54 are positioned inside the outer perimeter of the right end surface 12A. Therefore, as in the case of the second variation, the receiving part 12C and the internal teeth 54 do not protrude on the outside of the cartridge 1 from the right end surface 12A. As a result, the receiving part 12C and the internal teeth 54 are hard to collide against external substances on the outside of the cartridge 1. Consequently, it becomes possible to prevent the receiving part 12C and the internal teeth 54 from being damaged.

As in the cases of the second and third variations, according to the fourth variation, when the main body joint unit 22 reaches the advanced position and the main body joint unit 22 is coupled to the cartridge joint unit 6, the tip part 38 is received by the receiving part 12C along the rotation axis B.

In this case, the internal teeth 54 formed on the receiving part 12C achieve the spline fitting with respect to the external teeth 53 formed on the tip part 38. When the main body joint unit 22 rotates in this state, the internal teeth 54 and the external teeth 53 engage firmly with each other.

As a result, it becomes possible to contact closely the main body joint unit 22 with the cartridge joint unit 6 during rotation thereof.

As in the case of the third variation, according to the fourth variation, the external teeth 53 and the internal teeth 54 are formed to be twisted to the circumferential direction centering the rotation axis B and the rotation axis D (i.e., the rotation direction of the cartridge joint unit 6 and the main body joint unit 22 as indicated by the bold arrow in FIG. 9B), in regard to the direction pointing from the right side to the left side.

In this case, at a contacting portion between the external teeth 53 and the internal teeth 54, slanting parts are formed to intersect with the rotation axis B of the cartridge joint unit 6 (i.e., the rotation axis D of the main body joint unit 22). Therefore, when the main body transmission unit 22 rotates and thereby the external teeth 53 presses the internal teeth 54, a component force (i.e., the component force R shown in FIG. 7C) pointing in the direction of the rotation axis B (rotation axis D) is produced based on a pressing force of the external teeth 53. As a result, the internal teeth 54 (i.e., the cartridge joint unit 6) are drawn to the main body joint unit 22.

Consequently, it becomes possible to more closely contact the main body joint unit 22 with the cartridge joint unit 6 during rotation thereof.

What is claimed is:

1. An image forming device, comprising:

a device main body having a driving source generating a driving force;

a cartridge that is formed to be detachably attachable to the device main body and to include a rotation body provided to rotate by receiving the driving force from the driving source;

a main body transmission unit that is provided in the device main body, the main body transmission unit being configured to rotate about a first rotation axis by receiving the driving force from the driving source;

a main body joint unit that is supported by the main body transmission unit, the main body joint unit comprising a projected portion and being configured such that, in accordance with rotation of the main body transmission unit, the main body joint unit rotates about a second rotation axis which is allowed to intersect with the first rotation axis;

a cartridge transmission unit that is provided in the cartridge, the cartridge transmission unit being configured to be able to rotate about a third rotation axis and to transmit the driving force from the driving source to the rotation body by rotating about the third rotation axis; and a cartridge joint unit that is supported by the cartridge transmission unit, the cartridge joint unit comprising a recessed portion configured to receive the projected portion of the main body joint unit, the recessed portion comprising a tapered surface configured to guide the projected portion of the main body joint unit, wherein the cartridge joint unit is configured to be able to rotate about a fourth rotation axis which is allowed to intersect with the third rotation axis, and configured to rotate coaxially with respect to the main body joint unit and to cause the cartridge transmission unit to rotate when the main body transmission unit rotates in a state where the cartridge is attached to the device main body and the cartridge joint unit is coupled to the main body joint unit, wherein the projected portion of the main body joint unit comprises:

a fitting part; and a protrusion formed on an outer surface of the fitting part to protrude outward in a direction orthogonal to the second rotation axis, wherein the recessed portion of the cartridge joint unit comprises:

a receiving part formed to have a concave shape to receive the fitting part of the main body joint unit along the fourth rotation axis; and an engagement groove formed to engage with the protrusion formed on the outer surface of the fitting part and to be inclined such that a length and width of the engagement groove defines a plane parallel to the fourth rotation axis and a centerline of the engagement groove is set within the plane at an angle to a line parallel to the fourth rotation axis, and wherein the cartridge joint unit further comprises a cartridge joint unit protrusion that is aligned on the fourth rotation axis with the protrusion formed on the outer surface of the fitting part, when the cartridge joint unit and the main body joint unit are in a coupled state.

2. The image forming device according to claim 1, wherein:

the main body joint unit has a main body orthogonal surface which is orthogonal to the second rotation axis;

the cartridge joint unit has a cartridge orthogonal surface which is orthogonal to the fourth rotation axis; and the main body orthogonal surface and the cartridge orthogonal surface are in surface contact with each other in a state where the main body joint unit and the cartridge joint unit are coupled to each other.

3. The image forming device according to claim 2, wherein the main body joint unit and the cartridge joint unit closely contact with each other when the main body transmission unit rotates in a state where the main body joint unit and the cartridge joint unit are coupled to each other.

4. The image forming device according to claim 1, wherein, at an end of the fitting part on a side of the cartridge joint unit, a guide part is formed to be received by the receiving part prior to the fitting part, and the guide part is formed to have a petrosal shape tapering toward the side of the cartridge joint unit.

5. The image forming device according to claim 1, wherein the receiving part and the engagement groove are located on a cartridge transmission unit side with respect to the cartridge orthogonal surface.

6. A cartridge detachably attachable to a device main body, the device main body includes a main body transmission unit configured to rotate about a first rotation axis by receiving a driving force from a driving source; and a main body joint unit that is supported by the main body transmission unit, the main body joint unit comprising a projected portion and being configured such that, in accordance with rotation of the main body transmission unit, the main body joint unit rotates about a second rotation axis which is allowed to intersect with the first rotation axis;

the cartridge comprising:

a rotation body provided to rotate by receiving the driving force from the driving source in the device main body;

a cartridge transmission unit configured to be able to rotate about a third rotation axis and to transmit the driving force from the driving source to the rotation body by rotating about the third rotation axis; and a cartridge joint unit that is supported by the cartridge transmission unit, the cartridge joint unit comprising a recessed portion configured to receive the projected portion of the main body joint unit, the recessed portion comprising a tapered surface configured to guide the projected portion of the main body joint unit, wherein the cartridge joint unit is configured to be able to rotate about a fourth rotation axis which is allowed to intersect with the third rotation axis, and configured to rotate coaxially with respect to the main body joint unit and to cause the cartridge transmission unit to rotate when the main body transmission unit rotates in a state where the cartridge is attached to the device main body and the cartridge joint unit is coupled to the main body joint unit, wherein the projected portion of the main body joint unit comprises:

a fitting part; and a protrusion formed on an outer surface of the fitting part to protrude outward in a direction orthogonal to the second rotation axis, wherein the recessed portion of the cartridge joint unit comprises:

a receiving part formed to have a concave shape to receive the fitting part of the main body joint unit along the fourth rotation axis; and an engagement groove formed to engage with the protrusion formed on the outer surface of the fitting part and to be inclined such that a length and width of the engagement groove defines a plane parallel to the fourth rotation axis and a centerline of the engagement groove is set within the plane at an angle to a line parallel to the fourth rotation axis, and wherein the cartridge joint unit further comprises a cartridge joint unit protrusion that is aligned on the fourth rotation axis with the protrusion formed on the outer surface of the fitting part, when the cartridge joint unit and the main body joint unit are in a coupled state.

7. The cartridge according to claim 6, wherein:

the main body joint unit has a main body orthogonal surface which is orthogonal to the second rotation axis;

the cartridge joint unit has a cartridge orthogonal surface which is orthogonal to the fourth rotation axis; and the main body orthogonal surface and the cartridge orthogonal surface are in surface contact with each other in a state where the main body joint unit and the cartridge joint unit are coupled to each other.

8. The cartridge according to claim 7, wherein the main body joint unit and the cartridge joint unit closely contact with each other when the main body transmission unit rotates in a state where the main body joint unit and the cartridge joint unit are coupled to each other.

9. The cartridge according to claim 6, wherein, at an end of the fitting part on a side of the cartridge joint unit, a guide part is formed to be received by the receiving part prior to the fitting part, and the guide part is formed to have a petrosal shape tapering toward the side of the cartridge joint unit.

10. The cartridge according to claim 6, wherein the receiving part and the engagement groove are located on a cartridge transmission unit side with respect to the cartridge orthogonal surface.

* * * * *